US010288338B2

(12) United States Patent
Bae et al.

(10) Patent No.: US 10,288,338 B2
(45) Date of Patent: May 14, 2019

(54) REFRIGERATOR

(71) Applicant: SAMSUNG ELECTRONICS CO., LTD., Suwon-si (KR)

(72) Inventors: Jung Wook Bae, Suwon-si (KR); Kook Jeong Seo, Seoul (KR); Young Don Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 189 days.

(21) Appl. No.: 15/247,431

(22) Filed: Aug. 25, 2016

(65) Prior Publication Data

US 2017/0059224 A1 Mar. 2, 2017

(30) Foreign Application Priority Data

Aug. 28, 2015 (KR) ..... 10-2015-0121602
Dec. 22, 2015 (KR) ..... 10-2015-0183473

(51) Int. Cl.
*F25D 11/00* (2006.01)
*F25D 21/08* (2006.01)
(Continued)

(52) U.S. Cl.
CPC ..... *F25D 11/006* (2013.01); *F25D 17/062* (2013.01); *F25D 21/08* (2013.01);
(Continued)

(58) Field of Classification Search
CPC .... F25D 11/006; F25D 17/062; F25D 17/067; F25D 21/002; F25D 21/14; F25D 2317/067; F25D 21/08; F25D 21/06
See application file for complete search history.

(56) References Cited

U.S. PATENT DOCUMENTS 5,896,914 A * 4/1999 Fieback ..... F28D 1/0308 165/10
6,957,549 B2 * 10/2005 Kim ..... F25D 17/045 62/187
(Continued)

FOREIGN PATENT DOCUMENTS

EP 1 155 267 A1 11/2001
JP 2-302572 12/1990
(Continued)

OTHER PUBLICATIONS

International Search Report dated Nov. 22, 2016 in corresponding International Patent Application No. PCT/KR2016/009481.
(Continued)

*Primary Examiner* — Ana M Vazquez
(74) *Attorney, Agent, or Firm* — Staas & Halsey LLP

(57) ABSTRACT

Disclosed herein is a refrigerator configured to delay increase in temperature of a storage compartment by lowering temperature of air that is heated by a defrost heater. A refrigerator includes a defrost heater, a lower cool air duct including a first flow path configured to guide cool air generated by the evaporator to be supplied to the storage compartment and an upper cool air duct disposed in an upper side of the lower cool air duct and provided with a second flow path configured to guide cool air generated by the evaporator to be supplied to the storage compartment. A cool pack in which cold storage material is filled stores cold storage energy from cool air that is delivered to the second flow path to decrease a temperature of air passing via the second flow path, so that increase of an internal temperature of the storage compartment is delayed.

10 Claims, 40 Drawing Sheets

(51) Int. Cl.
*F25D 17/06* (2006.01)
*F25D 23/06* (2006.01)

(52) U.S. Cl.
CPC ..... *F25D 17/067* (2013.01); *F25D 23/067* (2013.01); *F25D 2317/067* (2013.01)

(56) References Cited

U.S. PATENT DOCUMENTS

| | | | | |
|---|---|---|---|---|
| 2011/0107779 | A1 | 5/2011 | Kwak et al. | |
| 2015/0121925 | A1* | 5/2015 | Park | F25B 49/022 62/151 |

FOREIGN PATENT DOCUMENTS

| | | | | |
|---|---|---|---|---|
| JP | 4-103980 | | 4/1992 | |
| JP | 10-292974 | | 11/1998 | |
| KR | 1993-0020128 | | 10/1993 | |
| KR | 10-2006-0106412 | | 10/2006 | |
| KR | 20060106412 | A * | 10/2006 | F25D 11/006 |
| KR | 10-2007-0098164 | | 10/2007 | |
| KR | 10-2012-0045765 | | 5/2012 | |
| KR | 10-2012-0072774 | | 7/2012 | |
| KR | 10-2013-0034817 | | 4/2013 | |
| KR | 10-2013-0129795 | | 11/2013 | |
| KR | 10-1458199 | | 10/2014 | |
| KR | 10-2015-0057109 | | 5/2015 | |
| WO | 00/37867 | | 6/2000 | |

OTHER PUBLICATIONS

Supplementary European Search Report dated Mar. 15, 2018, in corresponding European Patent Application No. 16842200.4, 4 pgs.
European Office Action dated Apr. 11, 2018, in corresponding European Patent Application No. 16 842 200.4, 7 pgs.
European Communication dated Oct. 23, 2018 in European Patent Application No. 16842200.4.

* cited by examiner

REFRIGERATOR

CROSS-REFERENCE TO RELATED APPLICATIONS

This application claims the benefit of Korean Patent Application No. 10-2015-0121602, filed on Aug. 28, 2015 and No. 10-2015-0183473 filed on Dec. 22, 2015 in the Korean Intellectual Property Office, the disclosure of which is incorporated herein by reference.

BACKGROUND

1. Field

Embodiments of the present disclosure relate to a refrigerator capable of delaying an increase of a temperature of a storage compartment by allowing a temperature of air that is heated by a defrost heater to be lowered and then discharged to the storage compartment.

2. Description of the Related Art

In general, a refrigerator is an apparatus configured to keep foods fresh while having a storage compartment and a cool air supplying apparatus to supply cool air to the storage compartment.

A temperature of the storage compartment is maintained in a certain range that is required to keep foods fresh.

The storage compartment of the refrigerator has an open front surface, and the opened front surface is usually closed by a door to maintain the temperature of the storage compartment.

The storage compartment is divided into a freezing compartment in the right side and a refrigerating compartment in the left side by a partition, and the freezing compartment and the refrigerating compartment are closed by a freezing compartment door and a refrigerating compartment door.

The inside of the storage compartment maintains a temperature thereof by receiving a cool air from a cool air supplying device, and the cool air supplying device includes an evaporator generating a cool air, a blower fan guiding the cool air generated by the evaporator so that the cool air is supplied to the storage compartment, and a cool air duct receiving the cool air guided by the blower fan and discharging the guided cool air to the storage compartment.

In the cool air duct, a plurality of discharging ports may be provided to discharge the received cool air to the storage compartment, but an ice or frost may be generated in the cool air discharging port due to the long use of the refrigerator.

A defrost heater may be operated to remove the ice or frost generated in the cool air discharging port. Air heated by the defrost heater removes the ice or frost generated in the cool air discharging port and then discharged to the storage compartment via the cool air discharging port.

Since the air that is heated by the defrost heater is discharged to the cool air discharging port while having a high temperature after removing the ice or frost generated in the cool air discharging port, there may cause a problem of increasing a temperature of the storage compartment.

SUMMARY

Therefore, it is an aspect of the present disclosure to provide a refrigerator capable of delaying an increase of a temperature of a storage compartment by allowing a temperature of air that is heated by a defrost heater to be lowered and then discharged to the storage compartment.

Additional aspects of the present disclosure will be set forth in part in the description which follows and, in part, will be obvious from the description, or may be learned by practice of the invention.

In accordance with one aspect of the present disclosure, a refrigerator includes a body, a storage compartment provided inside of the body to have an opened front surface, an evaporator provided in a rear side of the storage compartment to generate cool air, a defrost heater provided in a lower side of the evaporator, a lower cool air duct having a first flow path configured to guide cool air generated by the evaporator to be supplied to the storage compartment, and an upper cool air duct disposed in an upper side of the lower cool air duct where the upper cool air duct includes a second flow path configured to guide cool air generated by the evaporator to be supplied to the storage compartment. A cool pack in which storage material is filled stores cold storage energy from cool air passing through the second flow path of the upper cool air duct to decrease a temperature of air passing via the second flow path of ht upper cool air duct while the defrost heater is being operated, so that an increase of an internal temperature of the storage compartment is delayed.

The evaporator and a blower fan may configured to guide cool air generated by the evaporator to be delivered to the first flow path and the second flow path are mounted to the lower cool air duct, wherein the blower fan is mounted to an upper side of the evaporator.

The lower cool air duct may comprise a flow path unit to which the evaporator and the blower fan are mounted, and in which the first flow path is provided, and a first front cover provided in a front surface of the flow path unit to form a part of a rear wall of the storage compartment and provided with a plurality of first cool air discharging ports configured to discharge cool air that is delivered to the first flow path to the storage compartment.

The upper cool air duct may comprise a second front cover provided in a front surface of the cool pack to form a part of a rear wall of the storage compartment and provided with a plurality of second cool air discharging ports configured to discharge cool air that is delivered to the second flow path to the storage compartment.

The second flow path may be provided in a rear surface of the cool pack, wherein a rear cover configured to cover a rear side of the cool pack is provided in a rear side of the cool pack.

The cool pack may comprise an inlet configured to fill cold storage material and a third cool air discharging port provided in a position corresponding to the second cool air discharging port to discharge the cool air that is delivered to the second flow path to the storage compartment.

A plurality of protrusions protruded toward a rear side may be provided in a rear surface of the cool pack forming the second flow path.

An upper cool pack in which cold storage material may be filled is mounted to an upper portion of an inside of the storage compartment, wherein the upper cool pack stores cold storage energy from cool air discharged via the plurality of the second cool air discharging ports.

A coupling hole may be provided in the upper cool pack to allow the upper cool pack to be coupled to an upper portion of the inside of the storage compartment by a coupling member.

A plurality of fixation protrusions may be provided in the upper portion of the inside of the storage compartment, wherein a plurality of fixation unit is provided in the upper cool pack to be fixed by being coupled to the plurality of fixation protrusions.

The upper cool pack performs heat exchange with air, which is heated by the defrost heater when defrosting and then discharged via the plurality of the second cool air discharging ports by being passed through the second flow path, so that an increase of an internal temperature of the storage compartment may be delayed.

In accordance with another aspect of the present disclosure, a refrigerator includes a body, a storage compartment provided inside of the body to have an opened front surface, an evaporator provided in a rear side of the storage compartment to generate cool air, a defrost heater provided in a lower side of the evaporator, a lower cool air duct having a first flow path configured to guide cool air generated by the evaporator to be supplied to the storage compartment, an upper cool air duct disposed in an upper side of the lower cool air duct and provided with a second flow path configured to guide cool air generated by the evaporator to be supplied to the storage compartment. The refrigerator including a cool pack, in which cold storage material is filled, provided to an upper portion of an inside of the storage compartment, wherein the cool pack stores cold storage energy from cool air discharged from the upper cool air duct to decrease a temperature of air discharged from the upper cool air duct to the storage compartment while the defrost heater is being operated, so that increase in an internal temperature of the storage compartment due to heat from the defrost heater is delayed.

A coupling hole may be provided in the cool pack to allow the cool pack to be coupled to the upper portion of the inside of the storage compartment by a coupling member.

A plurality of fixation protrusions may be provided in the upper portion of the inside of the storage compartment, wherein a plurality of fixation unit is provided in the cool pack to be fixed by being coupled to the plurality of fixation protrusions.

In accordance with another aspect of the present disclosure, a refrigerator includes a body, a storage compartment provided inside of the body to have an opened front surface, an evaporator provided in a rear side of the storage compartment to generate cool air, a defrost heater provided in a lower side of the evaporator, a cool air duct provided with the evaporator mounted thereto and a flow path configured to guide cool air generated by the evaporator to be supplied to the storage compartment. The refrigerator includes a cool pack, in which cold storage material is filled, provided to an upper portion of an inside of the storage compartment, wherein the cool pack stores cold storage energy from cool air discharged from the cool air duct to decrease a temperature of air discharged from the cool air duct to the storage compartment while the defrost heater is operated, so that increase of an internal temperature of the storage compartment due to heat from the defrost heater is delayed.

The evaporator and a blower fan may configure to guide cool air generated by the evaporator to be delivered to the flow path are mounted to the lower cool air duct, wherein the blower fan is mounted to an upper side of the evaporator.

The cool air duct may comprise a flow path unit to which the evaporator and the blower fan are mounted, and in which the flow path is provided, and a front cover provided in a front surface of the flow path unit to form a rear wall of the storage compartment and provided with a plurality of cool air discharging ports configured to discharge cool air that is delivered to the flow path to the storage compartment.

A coupling hole may be provided in the cool pack to allow the cool pack to be coupled to the upper portion of the inside of the storage compartment by a coupling member.

A plurality of fixation protrusions may be provided in the upper portion of the inside of the storage compartment, wherein a plurality of fixation unit is provided in the cool pack to be fixed by being coupled to the plurality of fixation protrusions.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
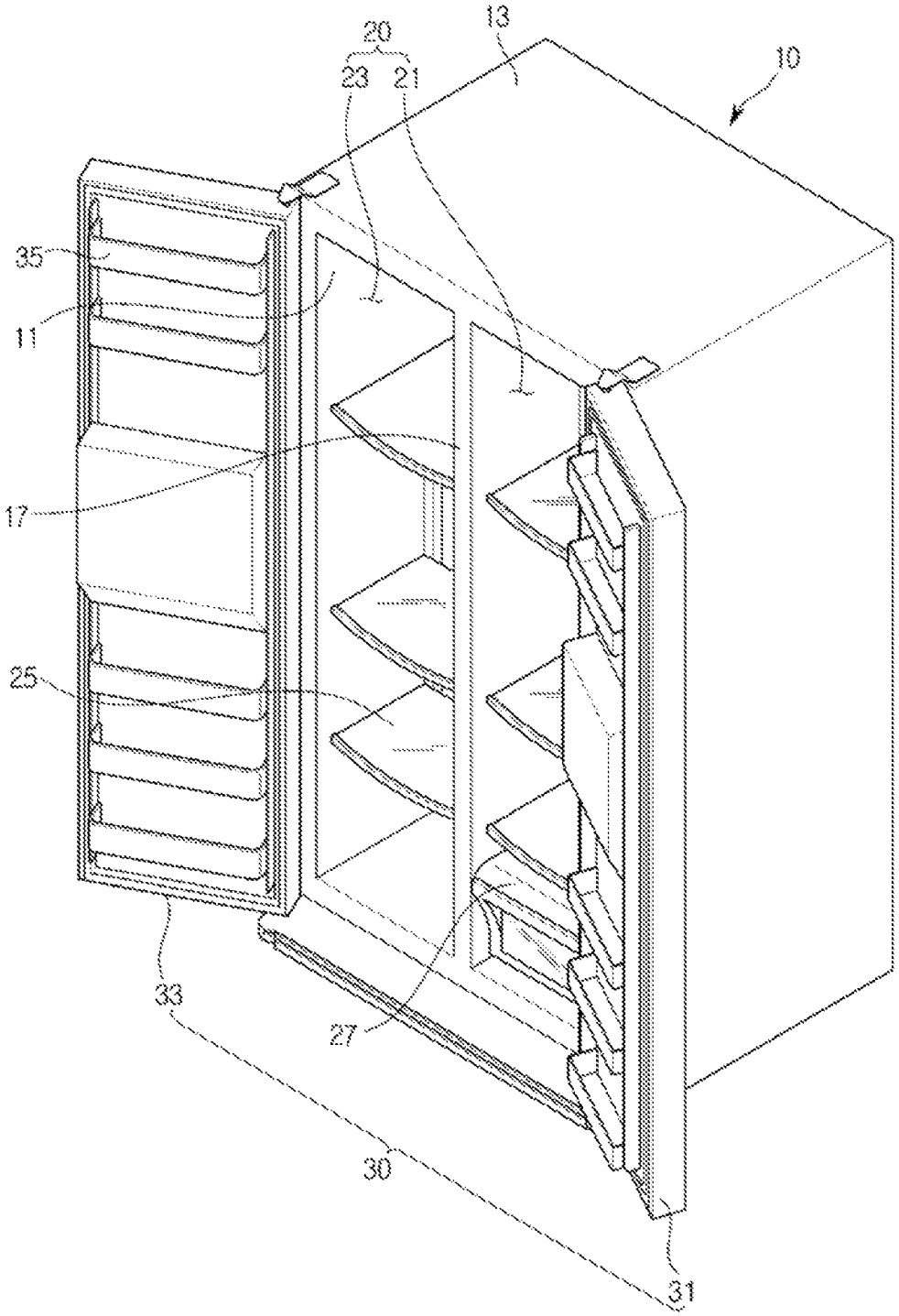
FIG. 1 is a perspective view illustrating a refrigerator in accordance with one embodiment of the present disclosure.

Reference will now be made in detail to embodiments of the present disclosure, examples of which are illustrated in the accompanying drawings, wherein like reference numerals refer to like elements throughout.

Figure 2:
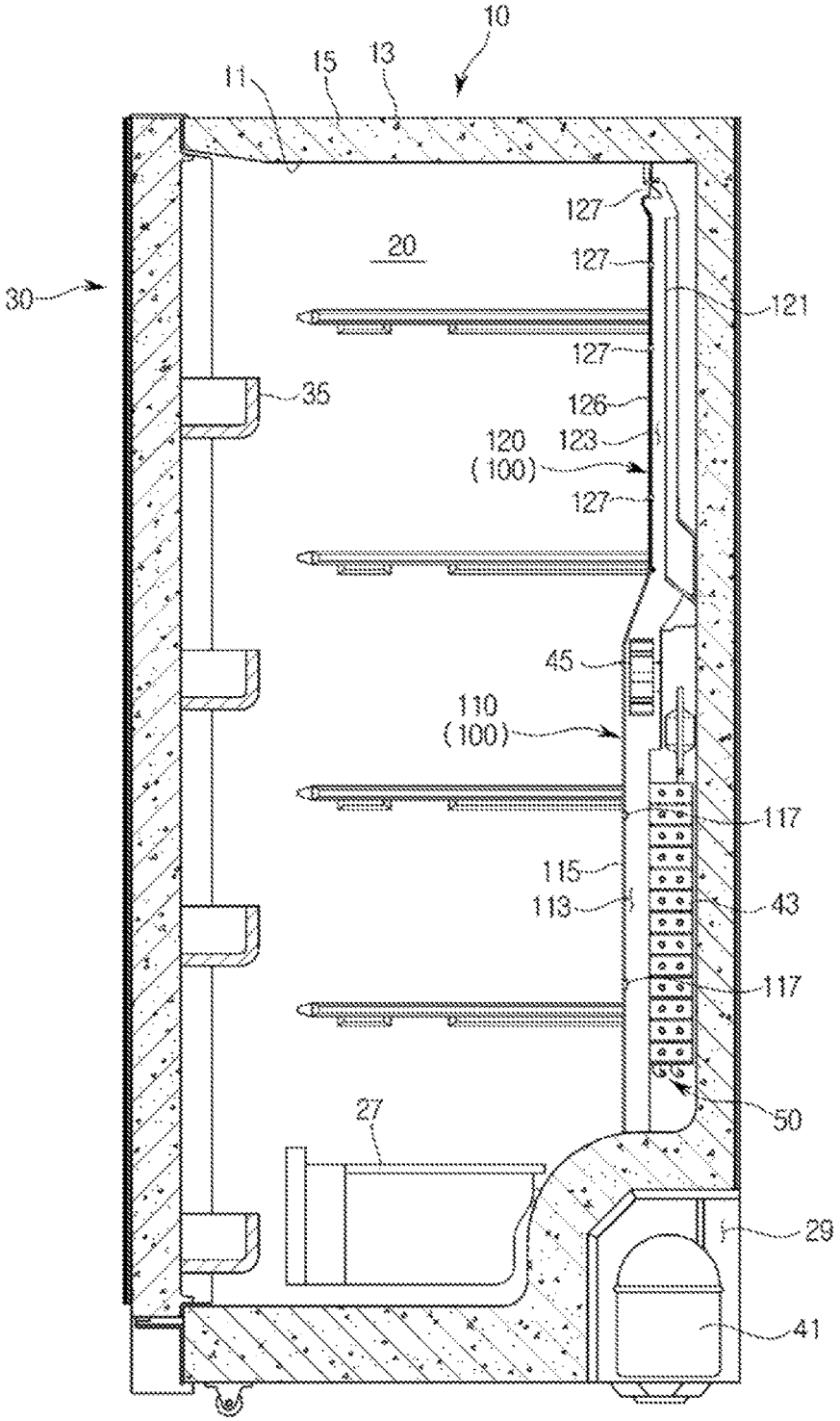
FIG. 2 is a cross-sectional view illustrating a refrigerator in accordance with one embodiment of the present disclosure.
Figure 3:
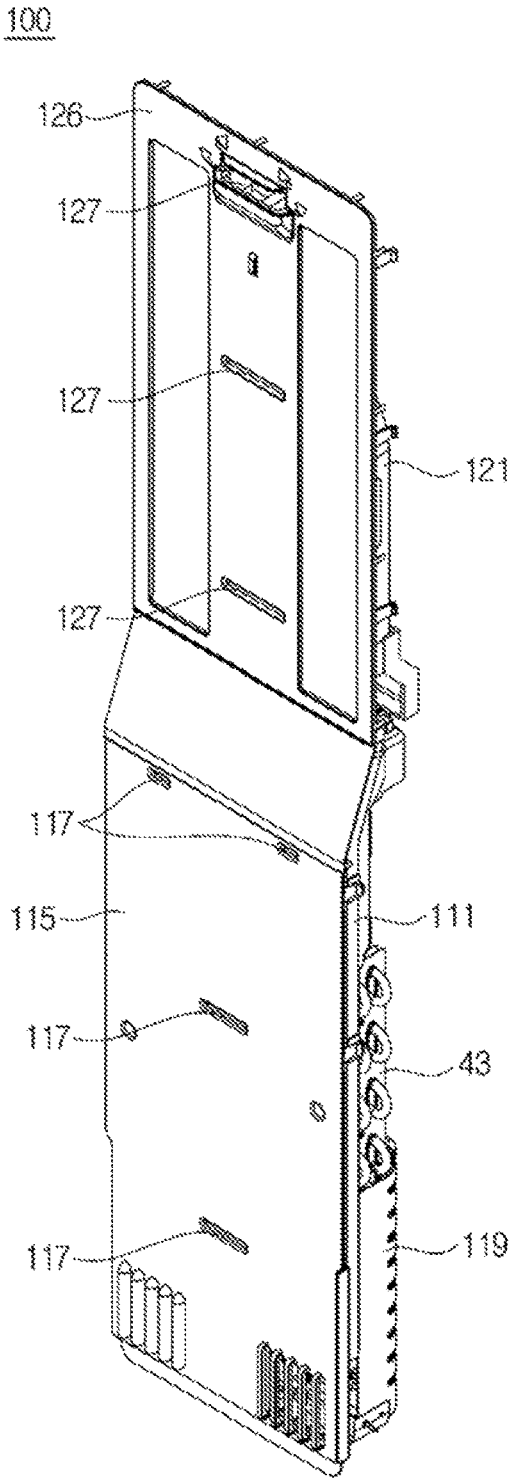
FIG. 3 is a perspective view illustrating a front surface of a cool air duct in accordance with one embodiment of the present disclosure.
Figure 4:
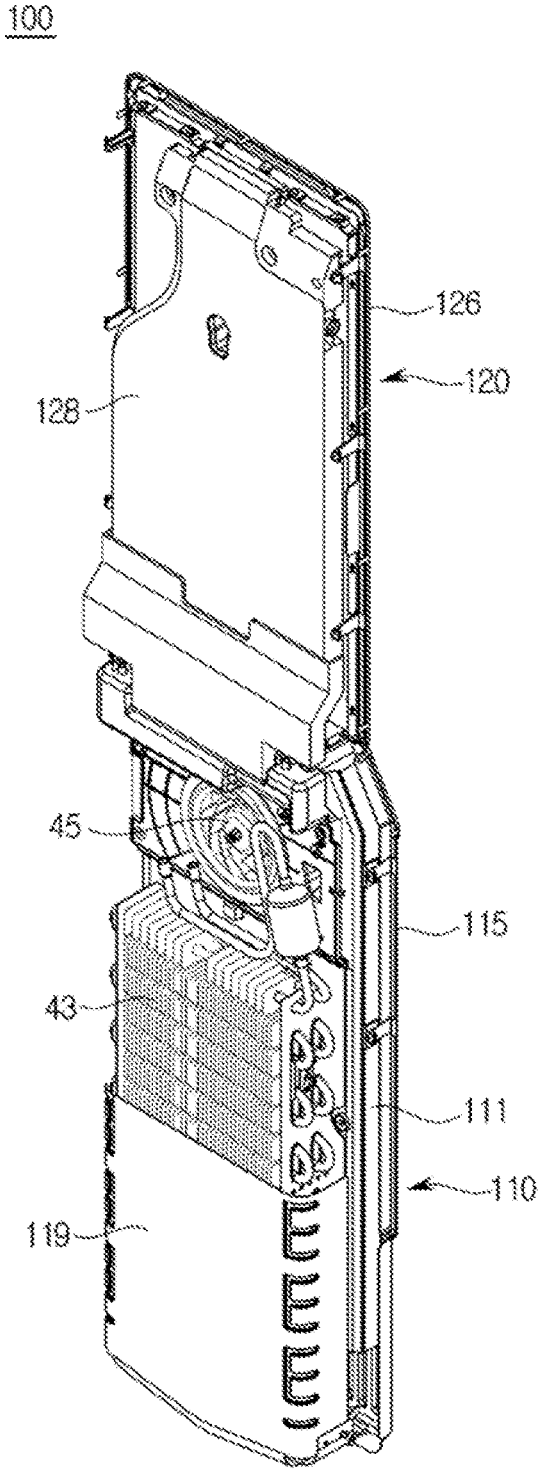
FIG. 4 is a perspective view illustrating a rear surface of a cool air duct in accordance with one embodiment of the present disclosure.
Figure 5:
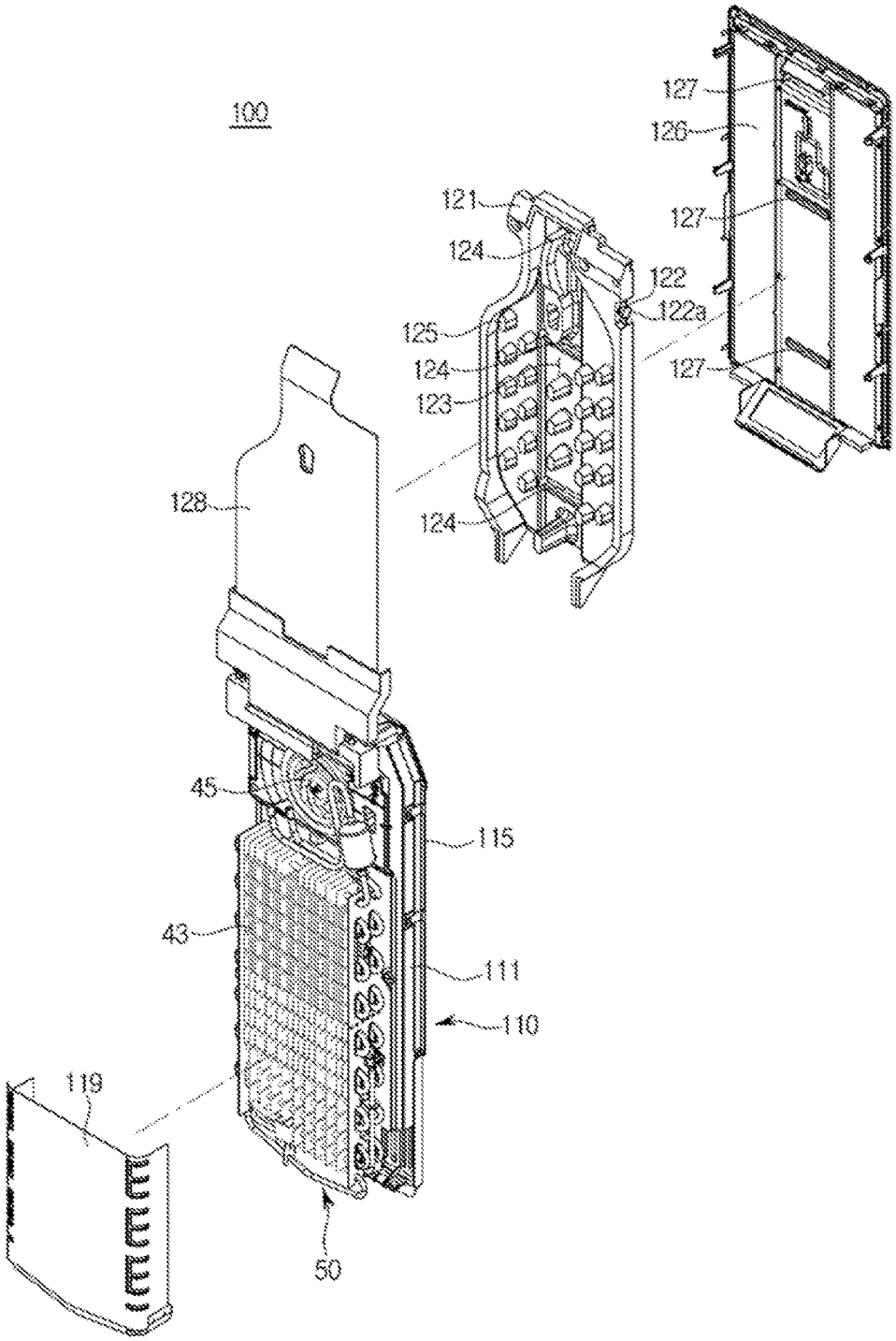
FIG. 5 is a an exploded-perspective view illustrating a cool air duct in accordance with one embodiment of the present disclosure.
Figure 6:
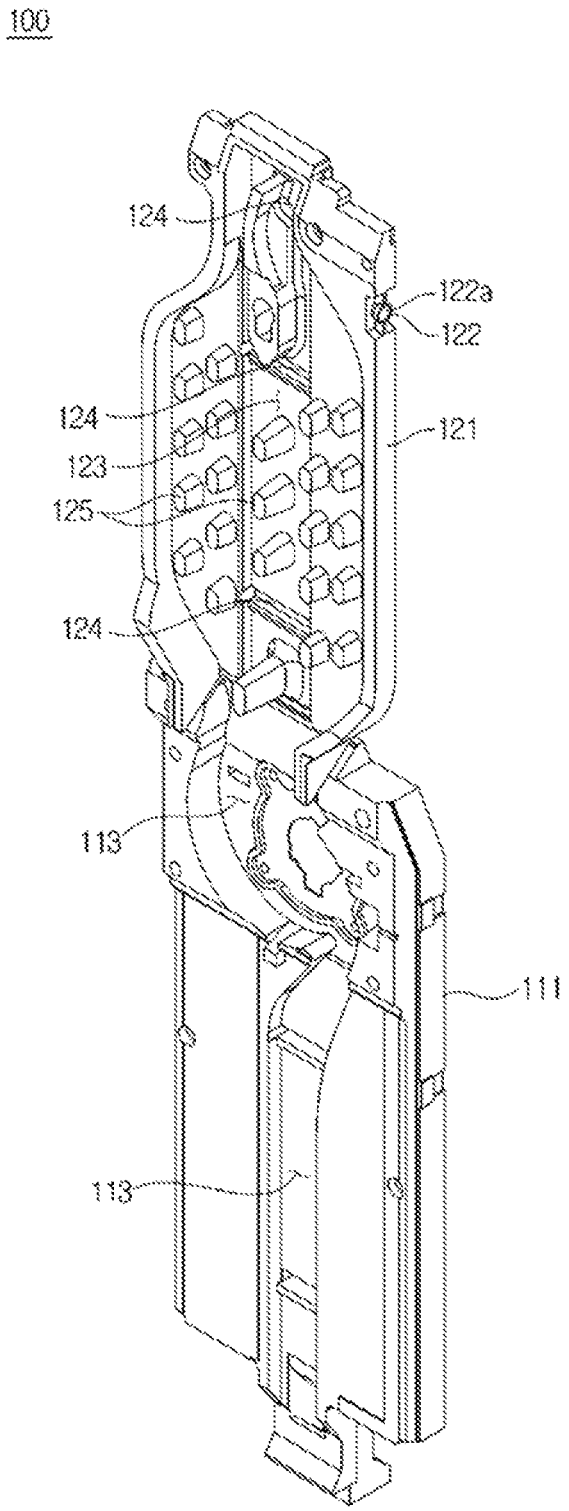
FIG. 6 is a view illustrating a first flow path and a second flow path of a cool air duct in accordance with one embodiment of the present disclosure.

As illustrated in FIGS. 1 and 2, a refrigerator may include a body 10 forming an exterior of the refrigerator; a storage compartment 20 provided inside of the body 10 to have an opened front surface thereof; and a door 30 rotatably coupled to the body 10 to open and close the opened front surface of the storage compartment 20.

The body 10 may include an inner case 11 forming the storage compartment 20 and an outer case 13 forming an exterior of the body 10, and an insulation material 15 may be foamed between the inner case 11 and the outer case 13 to prevent cool air of the storage compartment 20 from being leaked.

The body 10 may include a partition 17 dividing the storage compartment 20 into a refrigerating compartment 21 in the left side and a freezing compartment 23 in the right side. A machinery room 29 in which a compressor 41 configured to compress refrigerant and a condenser (not shown) configured to condense the compressed refrigerant are installed may be provided in a lower portion of the rear side of the body 10.

The storage compartment 20 may be divided into the left side and the right side by the partition 17, wherein the refrigerating compartment 21 may be provided in the right side of the body 10 and the freezing compartment 23 may be provided in the left side of the body 10.

In the inside of the storage compartment 20, a plurality of shelves 25 and storage containers 27 may be provided to store foods.

The storage compartment 20 may be opened or closed by the door 30 rotatably coupled to the body 10, and the refrigerating compartment 21 and the freezing compartment 23 which are divided into the left side and the right side by the partition 17 may be opened or closed by a refrigerating compartment door 31 and a freezing compartment door 33, respectively.

On the rear surface of the refrigerating compartment door 31 and the freezing compartment door 33, a plurality of door guards 35 may be provided to accommodate foods.

The cool air supplying device may include the compressor 41 and the condenser both of which are installed in the machinery room 29, an evaporator 43 installed in the rear surface of the storage compartment 20 to generate a cool air, a blower fan 45 provided in an upper side of the evaporator 43 to guide the cool air generated in the evaporator 43 to the storage compartment 20, and a cool air duct 100 configured to guide the cool air guided by the blower fan 45 to be discharged to the storage compartment 20.

A defrost heater 50 may be provided in a lower side of the evaporator 43. When an ice or frost is generated in the discharging port provided in the cool air duct 100 and thus cool air generated in the evaporator 43 is prevented from being discharged to the storage compartment 20, the defrost heater 50 may be operated to allow cool air to be smoothly discharged to the storage compartment 20 by removing an ice or frost generated in the discharging port.

As illustrated in FIGS. 2 to 6, the cool air duct 100 may be provided in a rear side of the storage compartment 20 to guide cool air generated by the evaporator 43 so that the cool air is supplied to the storage compartment 20.

The cool air duct 100 may include a lower cool air duct 110 provided in a lower portion of the rear side of the storage compartment 20 and an upper cool air duct 120 disposed on an upper side of the lower cool air duct 110 to be provided in an upper portion of the rear side of the storage compartment 20.

The evaporator 43 and the blower fan 45 may be mounted to the lower cool air duct 110, and alternatively, the blower fan 45 may be mounted to an upper side of the evaporator 43.

The lower cool air duct 110 may include a flow path unit 111 to which the evaporator 43 and the blower fan 45 are mounted, and in which a first flow path 113 configured to guide cool air generated by the evaporator 43 to be supplied to the storage compartment 20 is provided; a first front cover 115 provided in a front surface of the flow path unit 111 to form a part of a rear wall of the storage compartment 20; and a rear surface cover 119 provided in a rear surface of the flow path unit 111.

In the first front cover 115, a plurality of first cool air discharging ports 117 configured to discharge cool air, which is delivered to the first flow path 113, to the storage compartment 20 may be provided, and since the lower cool air duct 110 is placed in a lower portion of the rear side of the storage compartment 20, the cool air discharged from the plurality of first cool air discharging ports 117 may be supplied to a lower portion of the storage compartment 20.

The upper cool air duct 120 may be provided in an upper side of the lower cool air duct 110, and the upper cool air duct 120 may include a cool pack 121 in which a second flow path 123 configured to guide cool air generated by the evaporator 43 to be supplied to the storage compartment 20 is provided, a second front cover 126 provided in a front surface of the cool pack 121 to form a part of a rear wall of the storage compartment 20, and a rear cover 128 configured to cover a rear side of the cool pack 121.

In the second front cover 126, a plurality of second cool air discharging ports 127 configured to discharge cool air, which is delivered to the second flow path 123, to the storage compartment 20 may be provided, and since the upper cool air duct 120 is placed in an upper portion of the rear side of the storage compartment 20, the cool air discharged from the plurality of second cool air discharging ports 127 may be supplied to an upper portion of the storage compartment 20.

The cool pack 121 may be filled with cold storage material. The cool pack 121 may include an inlet 122 into which the cold storage material is put and a third cool air discharging port 124 provided in a position corresponding to the second cool air discharging port 127 to discharge the cool air that is delivered to the second flow path 123 to the storage compartment 20.

The inlet 122 into which the cold storage material is put may be provided to be opened and closed by a cap 122*a*, and after the inlet 122 is opened by pulling the cap 122*a* from the inlet 122, the cold storage material may be put into the inside of the cool pack 121 and then the inlet 122 may be closed by the cap 122*a* when putting the cold storage material is completed.

Since the cold storage material is filled in the inside of the cool pack 121, the cool pack 121 may store cold storage energy from cool air that is passed through the second flow path 123 in a process in which cool air generated by the evaporator 43 is discharged to the storage compartment 20 via the second flow path 123.

A plurality of protrusions 125 protruding toward a rear side may be provided in a rear surface of the cool pack 121 forming the second flow path 123.

The plurality of protrusions 125 may be provided on the second flow path 123 to allow heat exchange with the cool pack 121 to be effectively performed when cool air generated by the evaporator 43 or air heated by the defrost heater 50 is passed through the second flow path 123.

Figure 7:
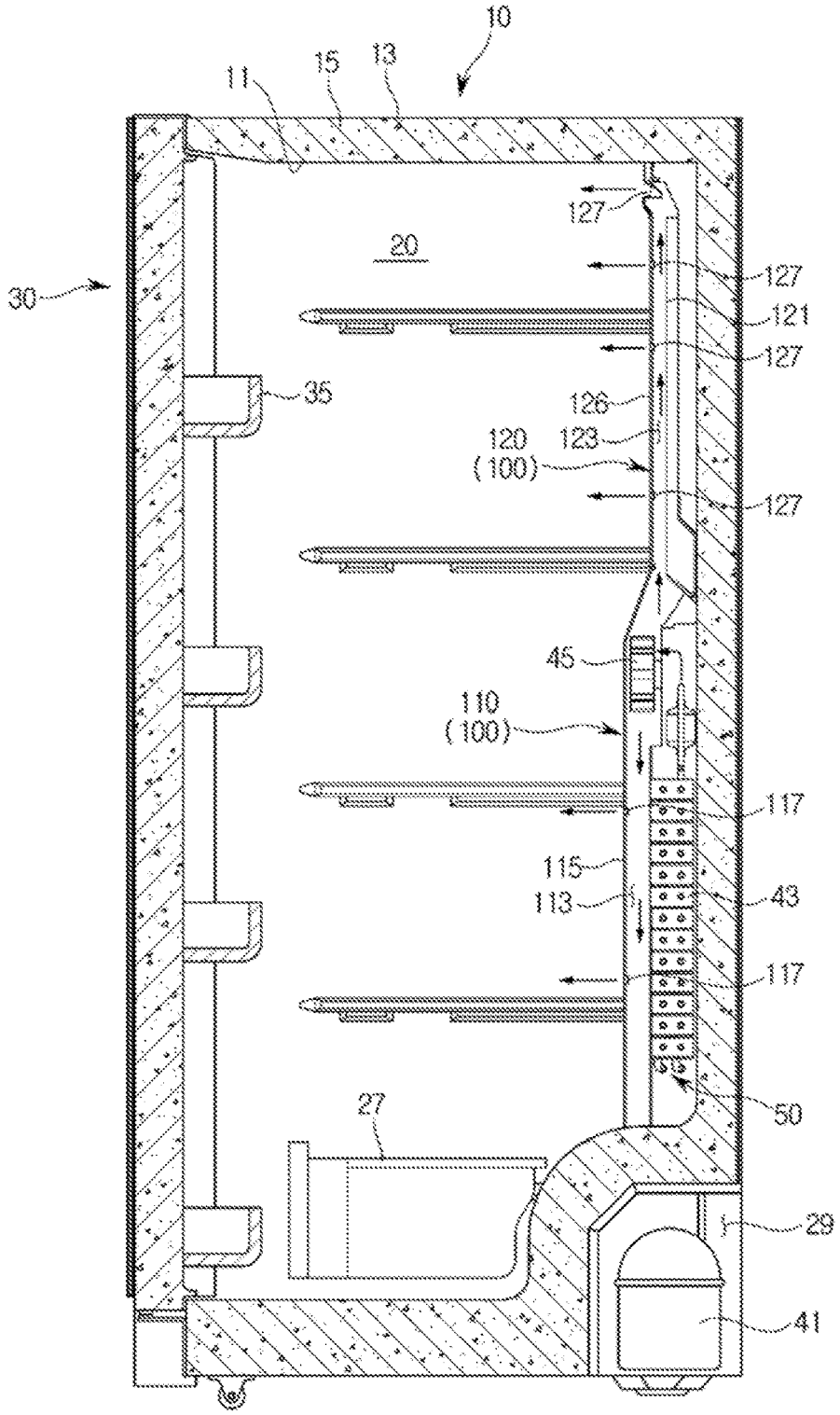
FIG. 7 is a view illustrating that cool air generated by an evaporator of a refrigerator is supplied to a storage compartment in accordance with one embodiment of the present disclosure.

As illustrated in FIG. 7, when the refrigerator is operated, cool air generated by the evaporator 43 may be typically guided to the first flow path 113 of the lower cool air duct 110 and the second flow path 123 of the upper cool air duct 120 by the blower fan 45.

Cool air guided to the first flow path 113 may be discharged to a lower side of the storage compartment 20 via the first cool air discharging port 117 of the first front cover 115 and cool air guided to the second flow path 123 may be discharged to an upper side of the storage compartment 20 via the second cool air discharging port 127 of the second front cover 126.

The cool pack 121 may store cold storage energy from cool air that is passed through the second flow path 123 in a process in which cool air is discharged to the storage compartment 20.

Figure 8:
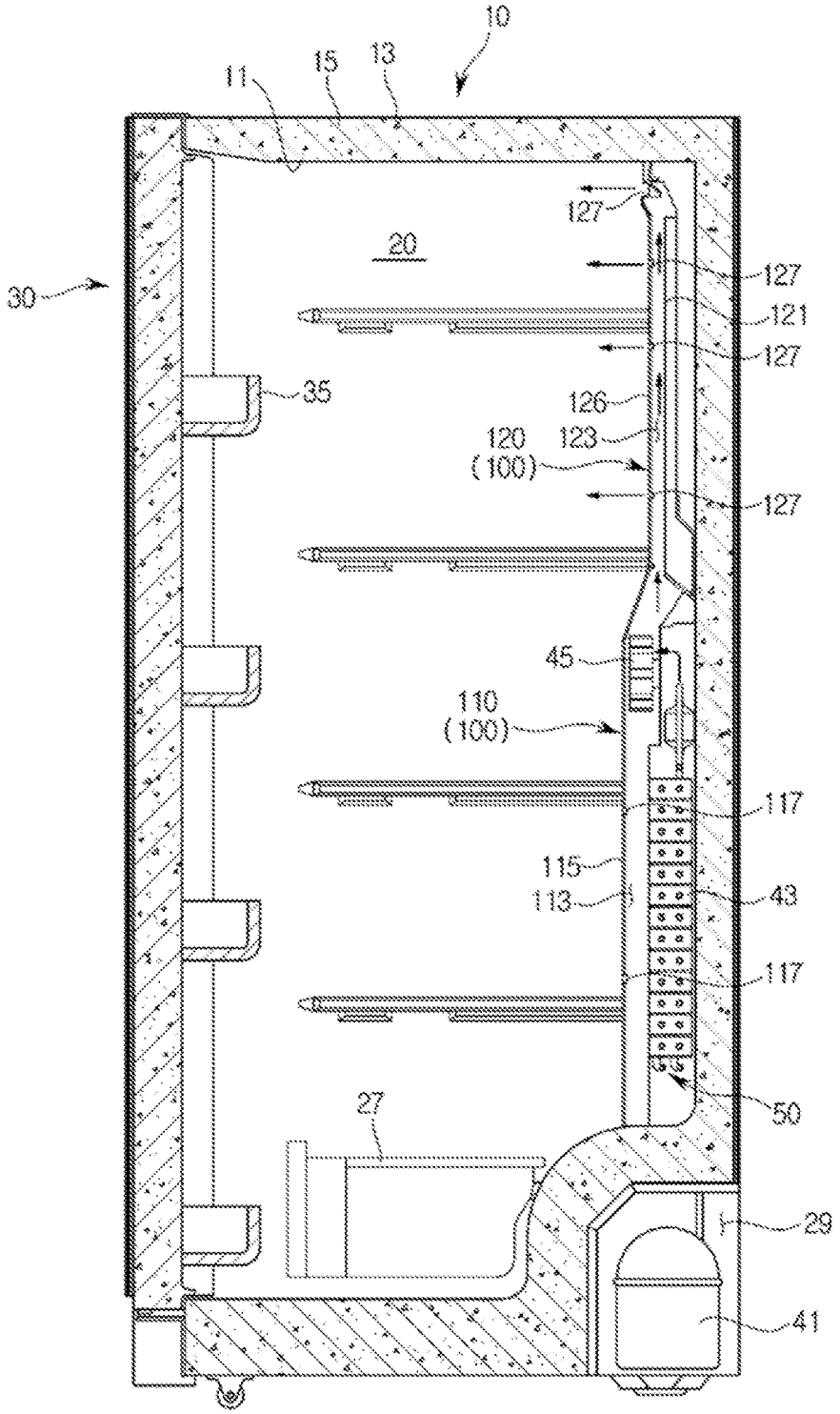
FIG. 8 is a view illustrating that air heated by a defrost heater of a refrigerator is discharged to a storage compartment in accordance with one embodiment of the present disclosure.

As illustrated in FIG. 8, when cool air is not smoothly discharged to the storage compartment 20 since an ice or frost is generated in the second cool air discharging port 127 of the second front cover 126, the defrost heater 50 may be operated.

When the defrost heater 50 is operated, air heated by the defrost heater 50 may be raised due to natural convection and then guided to the second flow path 123 of the upper cool air duct 120.

Since air guided to the second flow path 123 is maintained in a high temperature, an ice or frost generated in the second cool air discharging port 127 of the second front cover 126 may be removed by the air having a high temperature so that cool air is smoothly supplied to the storage compartment 20.

Air heated by the defrost heater 50 may be discharged to the storage compartment 20 via the second cool air discharging port 127 after removing the ice or frost generated in the second cool air discharging port 127 of the second front cover 126.

In a process in which air heated by the defrost heater 50 passes through the second flow path 123, a temperature of the air may be lowered by performing heat exchange with the cool pack 121 in which cold storage energy is stored, and air in a lowered temperature may be discharged to the storage compartment 20 via the second cool air discharging port 127 so that the air having a high temperature that is heated by the defrost heater 50 is prevented from being directly discharged to the storage compartment 20.

Since the air heated by the defrost heater 50 is not directly discharged to the storage compartment 20 while having a high temperature, but the air is discharged to the storage compartment 20 after decreasing a temperature thereof due to the heat exchange, a temperature of the storage compartment 20 may be prevented from being increased.

Since the plurality of protrusions 125 is provided on the rear surface of the cool pack 121 forming the second flow path 123, a period of time when the air heated by the defrost heater 50 is placed in the second flow path 123 may be increased. Accordingly, the air heated by the defrost heater 50 may perform the heat exchange for a long time to have a lower temperature than a temperature of air in a state in which the plurality of the protrusion 125 do not exist, and then the air may be discharged to the storage compartment 20.

Figure 9:
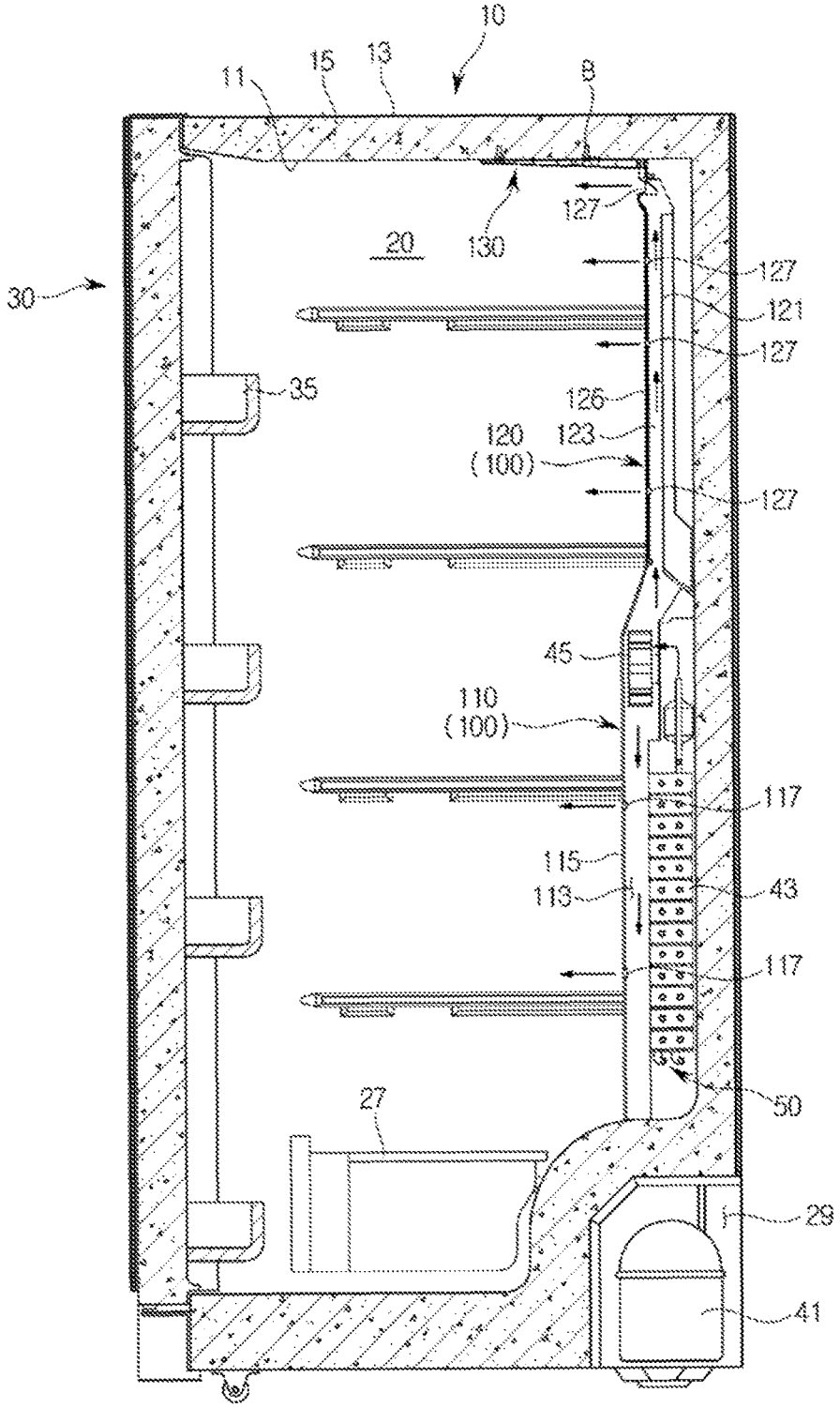
FIG. 9 is a view illustrating that cool air generated by an evaporator of a refrigerator is supplied to a storage compartment in accordance with another embodiment of the present disclosure.

As illustrated in FIG. 9, an upper cool pack 130 in which cold storage material is filled may be mounted to an upper portion of the inside of the storage compartment 20.

In a process in which cool air generated by the evaporator 43 is discharged to the storage compartment 20 via the second flow path 123, the upper cool pack 130 may store cold storage energy from cool air that is passed through the second flow path 123 and then discharged via the plurality of the second cool air discharging port 127.

Particularly, the upper cool pack 130 may store cold storage energy from cool air that is discharged from the second cool air discharging port 127 that is placed in the most upper side among the plurality of the second cool air discharging port 127.

Figure 10:
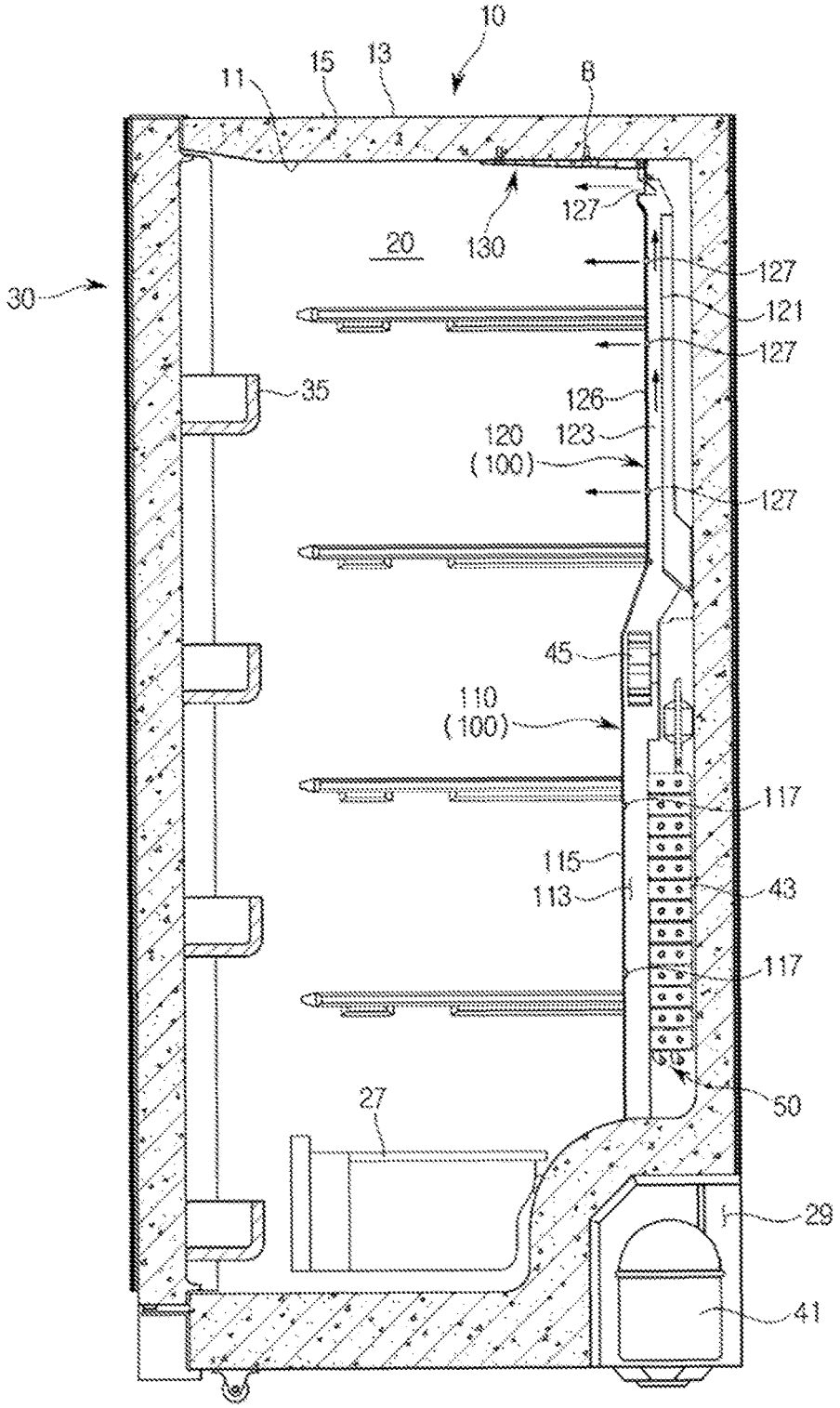
FIG. 10 is a view illustrating that air heated by a defrost heater of a refrigerator is discharged to a storage compartment in accordance with another embodiment of the present disclosure.

As illustrated in FIG. 10, when the defrost heater 50 is operated to remove the ice or frost generated in the second cool air discharging port 127 of the second front cover 126, air heated by the defrost heater 50 may be raised due to natural convection and then guided to the second flow path 123 of the upper cool air duct 120.

Since air guided to the second flow path 123 is maintained in a high temperature, an ice or frost generated in the second cool air discharging port 127 of the second front cover 126 may be removed by the air having a high temperature so that cool air is smoothly supplied to the storage compartment 20.

Air heated by the defrost heater 50 may be discharged to the storage compartment 20 via the second cool air discharging port 127 after removing the ice or frost generated in the second cool air discharging port 127 of the second front cover 126.

In a process in which air heated by the defrost heater 50 passes through the second flow path 123, a temperature of the air may be lowered by performing heat exchange with the cool pack 121 in which the cold storage energy is stored, and air in a lowered temperature may be discharged to the storage compartment 20 via the second cool air discharging port 127 so that the air having a high temperature that is heated by the defrost heater 50 is prevented from being directly discharged to the storage compartment 20.

Although the air heated by the defrost heater 50 is discharged to the storage compartment 20 while being in a lowered temperature due to the heat exchange with the cool pack 121, a temperature of air discharged to the second cool air discharging port 127 may be higher than a temperature of air inside of the storage compartment 20 and thus a temperature of the storage compartment 20 may be increased by a certain level.

However, since the upper cool pack 130 in which the cold storage energy is stored may be additionally provided in the upper portion of the inside of the storage compartment 20, a temperature of air, which is discharged from the second cool air discharging port 127 that is placed in the most upper side among the plurality of the second cool air discharging port 127, may be lowered due to the heat exchange with the upper cool pack 130.

In addition, a temperature of air, which is discharged from the remaining second cool air discharging port 127 except for the second cool air discharging port 127 that is placed in the most upper side among the plurality of the second cool air discharging port 127, may be lowered by the upper cool pack 130 disposed inside of the storage compartment 20 so that a temperature of entire inside of the storage compartment 20 may be maintained in a low temperature.

Figure 11:
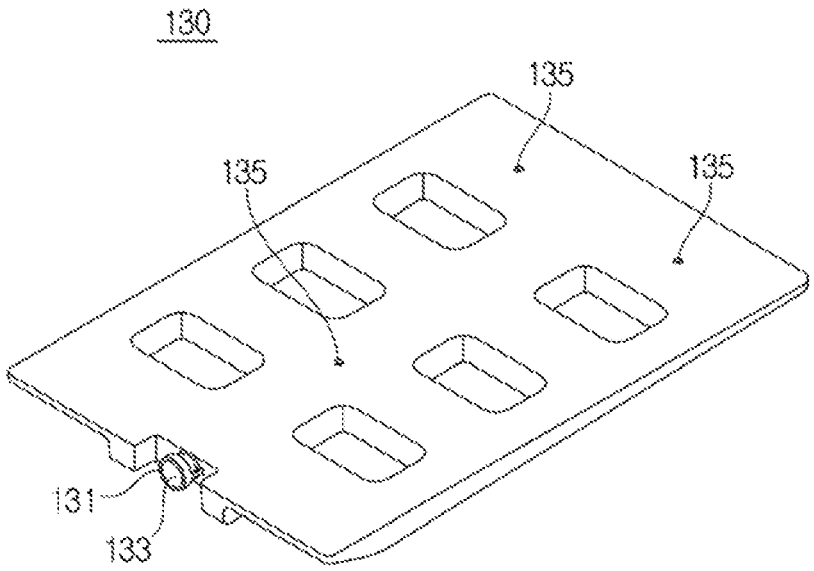
FIG. 11 is a view illustrating an upper cool pack of FIG. 9.
Figure 12:
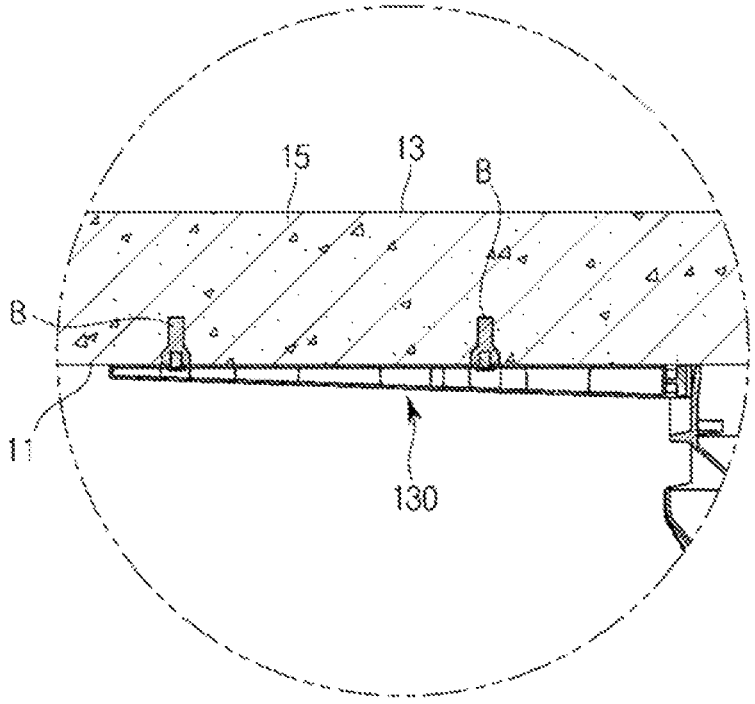
FIG. 12 is a partial enlarged view illustrating that an upper cool pack of FIG. 9 is mounted to an upper portion of the inside of a storage compartment.

As illustrated in FIGS. 11 and 12, the upper cool pack 130 may include an inlet 131 into which cold storage material is put, and a coupling hole 135 configured to mount the upper cool pack 130 to the upper portion of the inside of the storage compartment 20.

The inlet 131 may be provided to be opened and closed by a cap 133, and after the inlet 131 is opened by pulling the cap 133 from the inlet 131, the cold storage material may be put into the inside of the upper cool pack 130 and then the inlet 131 may be closed by the cap 133 when putting the cold storage material is completed.

When the cold storage material is put into the inside of the upper cool pack 130 and then the inlet 131 is closed by the cap 133, the upper cool pack 130 may be mounted to an upper surface of the inside of the storage compartment 20 through a coupling member (B) that is inserted into the coupling hole 135.

Figure 13:
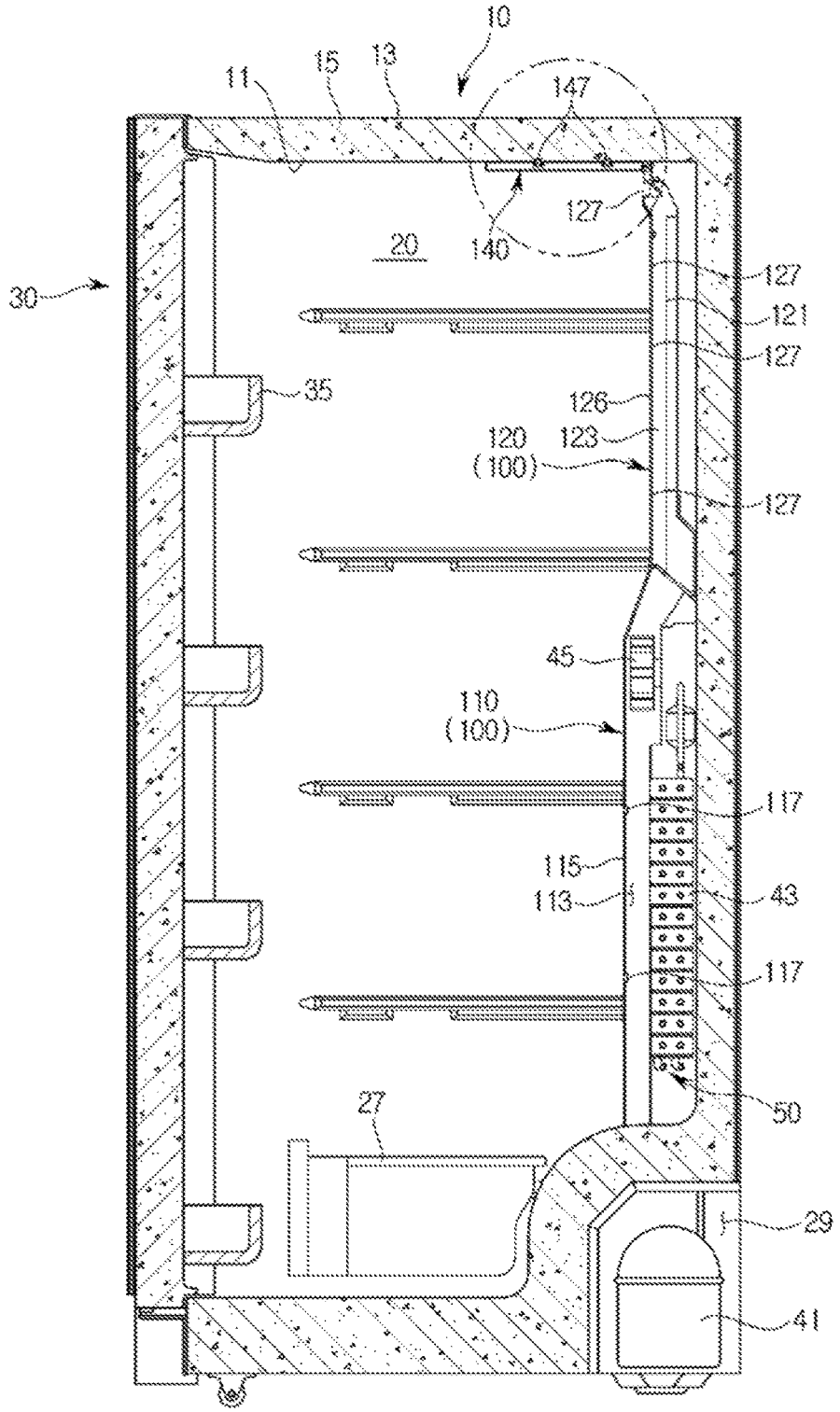
FIG. 13 is a cross-sectional view illustrating a refrigerator in accordance with another embodiment of the present disclosure.
Figure 14:
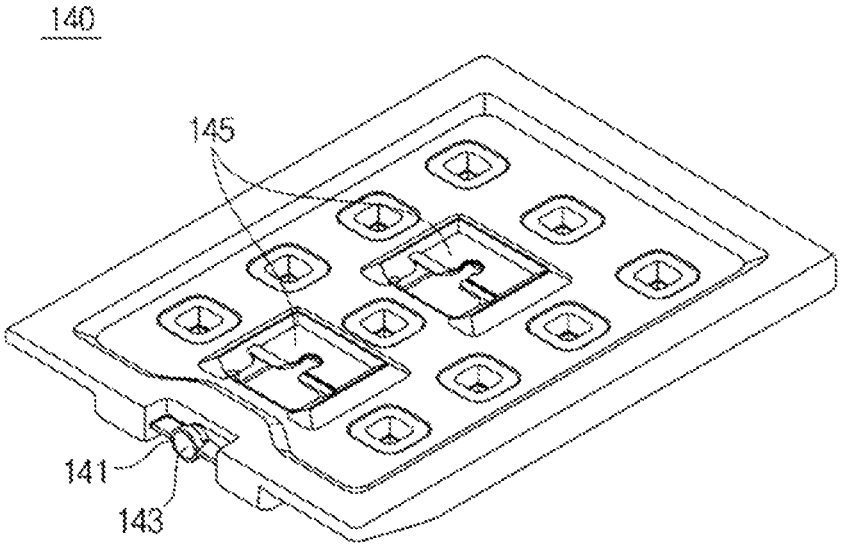
FIG. 14 is a view illustrating an upper cool pack of FIG. 13.
Figure 15:
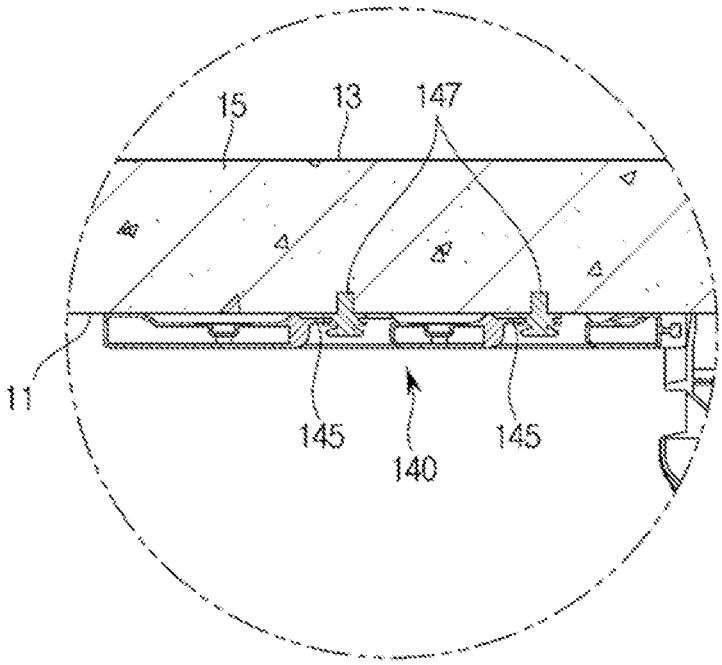
FIG. 15 is a partial enlarged view illustrating that an upper cool pack of FIG. 13 is mounted to an upper portion of the inside of a storage compartment.

As illustrated in FIGS. 13 to 15, an upper cool pack 140 may be fixed by being coupled to a plurality of fixation protrusions 147 provided in an upper portion of the inside of the storage compartment 20.

The upper cool pack 140, which is fixed by being coupled to the plurality of fixation protrusions 147 provided in the upper portion of the inside of the storage compartment 20, may include an inlet 141 into which the cold storage material is put, and a plurality of fixation units 145 fixed such that the plurality of the fixation protrusions 147 is inserted thereto.

The inlet 141 may be provided to be opened and closed by a cap 143, and after the inlet 141 is opened by pulling the cap 143 from the inlet 141, the cold storage material may be put into the inside of the upper cool pack 140 and then the inlet 141 may be closed by the cap 143 when putting the cold storage material is completed.

When the cold storage material is put into the inside of the upper cool pack 140 and then the inlet 141 is closed by the cap 143, the upper cool pack 140 may be mounted to an upper surface of the inside of the storage compartment 20 such that the plurality of the fixation units 145 is coupled to the plurality of the fixation protrusions 147 provided on the upper portion of the inside of the storage compartment 20.

Figure 16:
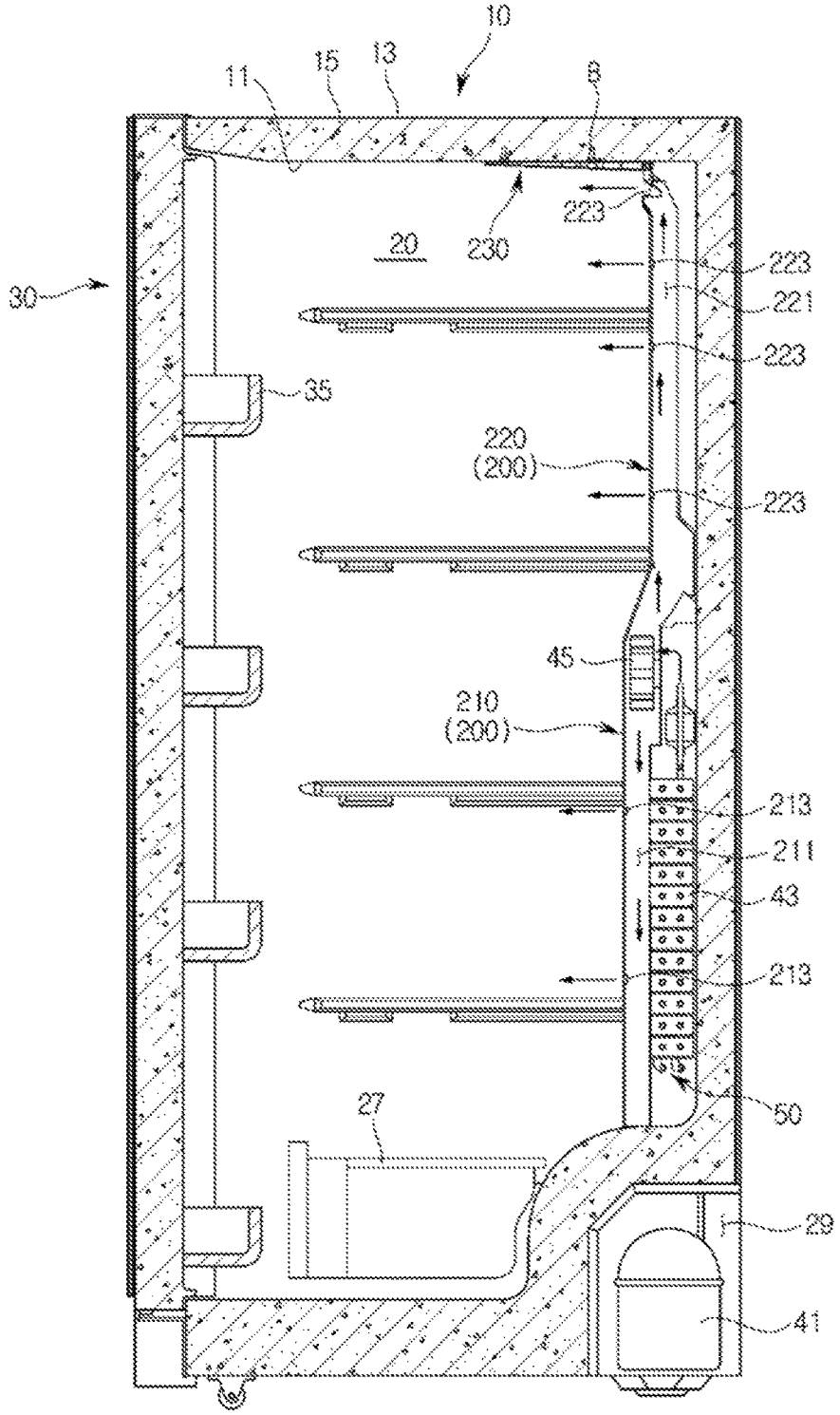
FIG. 16 is a view illustrating that cool air generated by an evaporator of a refrigerator is supplied to a storage compartment in accordance with another embodiment of the present disclosure.

As illustrated in FIG. 16, in a lower portion of the rear side of the storage compartment 20, an evaporator 43 may be mounted and a first flow path 211 configured to guide cool air generated by the evaporator 43 to be supplied to the storage compartment 20 may be provided. In an upper portion of the rear side of the storage compartment 20, an upper cool air duct 220 may be provided in an upper side of the lower cool air duct 210 and provided with a second flow path 221 configured to guide cool air generated by the evaporator 43 to be supplied to the storage compartment 20.

The configuration of the lower cool air duct 210 is to discharge cool air generated by the evaporator 43 to the first cool air discharging port 213, and is the same as the configuration of the lower cool air duct 110 illustrated in FIG. 7. Therefore, a description of the same parts as those shown in FIG. 7 will be omitted.

The upper cool air duct 220 may be configured to have the second flow path 221 to which cool air generated by the evaporator 43 is guided by the blower fan 45 and a plurality of second cool air discharging ports 223 provided in a front surface to discharge cool air, which is guided to the second flow path 221, to the storage compartment 20.

A cool pack 230 configured to store cold storage energy from cool air generated by the evaporator 43 may be not provided in the upper cool air duct 220 but in an upper portion of the inside of the storage compartment 20.

In a process in which cool air generated by the evaporator 43 is discharged to the storage compartment 20 via the second flow path 221, the cool pack 230 may store the cold storage energy from cool air that is passed through the second flow path 221 and discharged via the plurality of the second cool air discharging port 223.

Particularly, the cool pack 230 may store the cold storage energy from cool air that is discharged from the second cool air discharging port 223 that is placed in the most upper side among the plurality of the second cool air discharging port 223.

Figure 17:
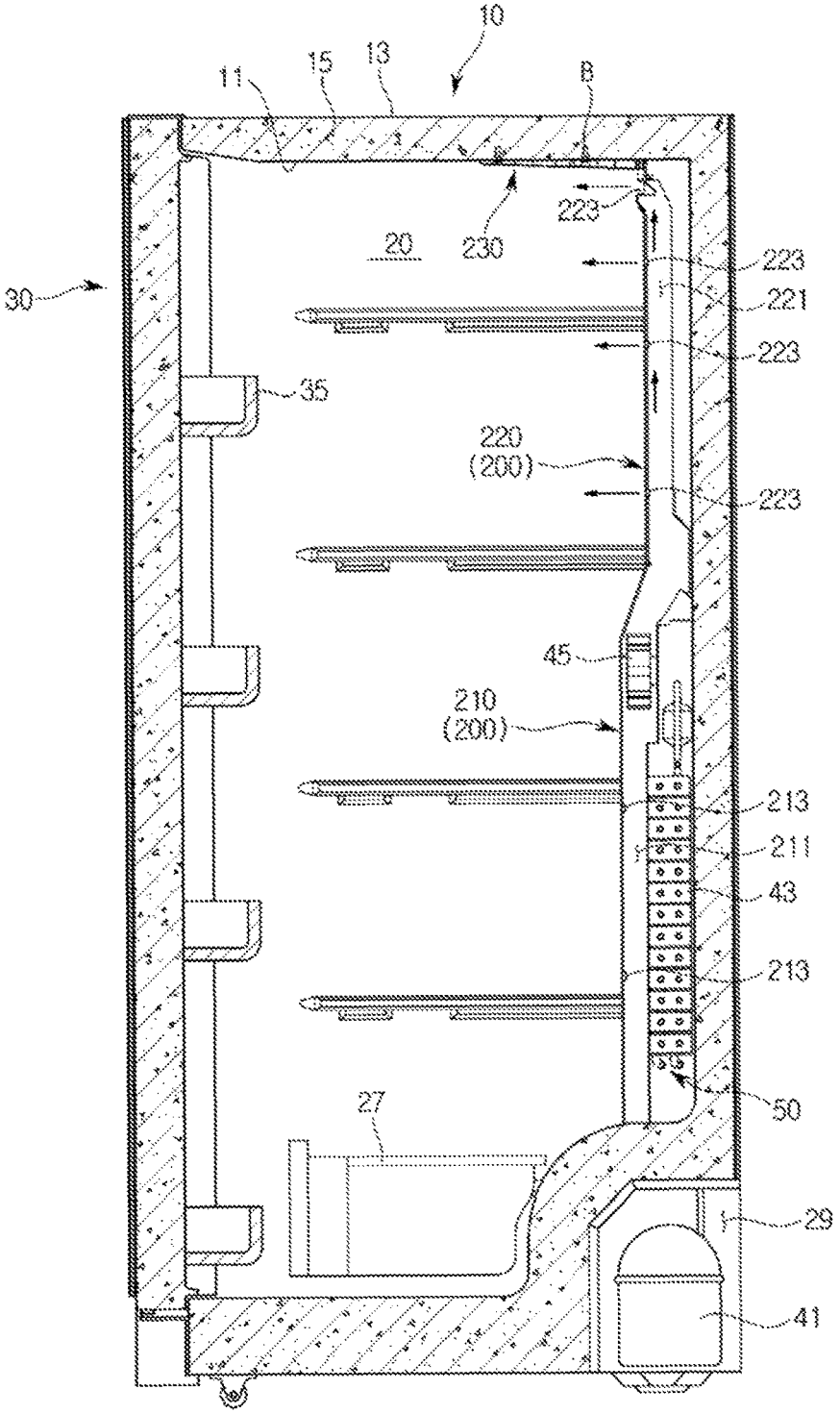
FIG. 17 is a view illustrating that air heated by a defrost heater of a refrigerator is discharged to a storage compartment in accordance with another embodiment of the present disclosure.

As illustrated in FIG. 17, when the defrost heater 50 is operated to remove the ice or frost generated in the second cool air discharging port 223, air heated by the defrost heater 50 may be raised due to natural convection and then guided to the second flow path 221 of the upper cool air duct 220.

Since air guided to the second flow path 221 is maintained in a high temperature, the ice or frost generated in the second cool air discharging port 223 may be removed by the air having a high temperature so that cool air is smoothly supplied to the storage compartment 20.

Air heated by the defrost heater 50 may be discharged to the storage compartment 20 via the second cool air discharging port 223 after removing the ice or frost generated in the second cool air discharging port 223.

Since air heated by the defrost heater 50 is discharged to the storage compartment 20 via the plurality of the second cool air discharging port 223, and the cool pack 230 configured store the cold storage energy is disposed on the upper portion of the inside of the storage compartment 20, a temperature of air, which is discharged via the second cool air discharging port 223 that is placed in the most upper side among the plurality of the second cool air discharging port 223, may be lowered due to the heat exchange with the cool pack 230.

A temperature of air, which is discharged from the remaining second cool air discharging port 223 except for the second cool air discharging port 223 that is placed in the most upper side among the plurality of the second cool air discharging port 223, may be lowered by the cool pack 230 disposed inside of the storage compartment 20 so that a temperature of entire inside of the storage compartment 20 may be maintained in a low temperature.

Figure 18:
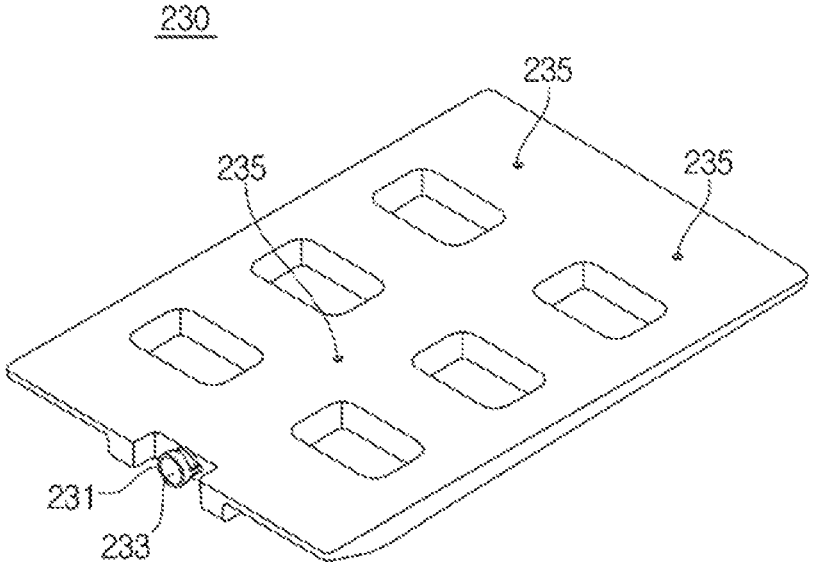
FIG. 18 is a view illustrating a cool pack of FIG. 16.
Figure 19:
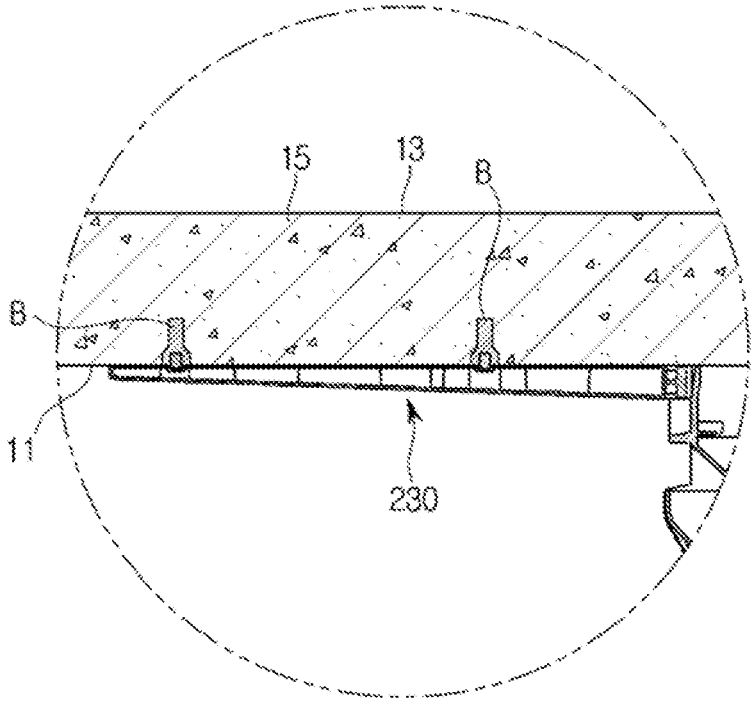
FIG. 19 is a partial enlarged view illustrating that a cool pack of FIG. 16 is mounted to an upper portion of the inside of a storage compartment.

As illustrated in FIGS. 18 and 19, the cool pack 230 may include an inlet 231 into which cold storage material is put, and a coupling hole 235 configured to mount the cool pack 230 to the upper portion of the inside of the storage compartment 20.

The inlet 231 may be provided to be opened and closed by a cap 233, and after the inlet 231 is opened by pulling the cap 233 from the inlet 231, the cold storage material may be put into the inside of the cool pack 230 and then the inlet 231 may be closed by the cap 233 when putting the cold storage material is completed.

When the cold storage material is put into the inside of the cool pack 230 and then the inlet 231 is closed by the cap 233, the cool pack 230 may be mounted to an upper surface of the inside of the storage compartment 20 through a coupling member (B) that is inserted into the coupling hole 235.

Figure 20:
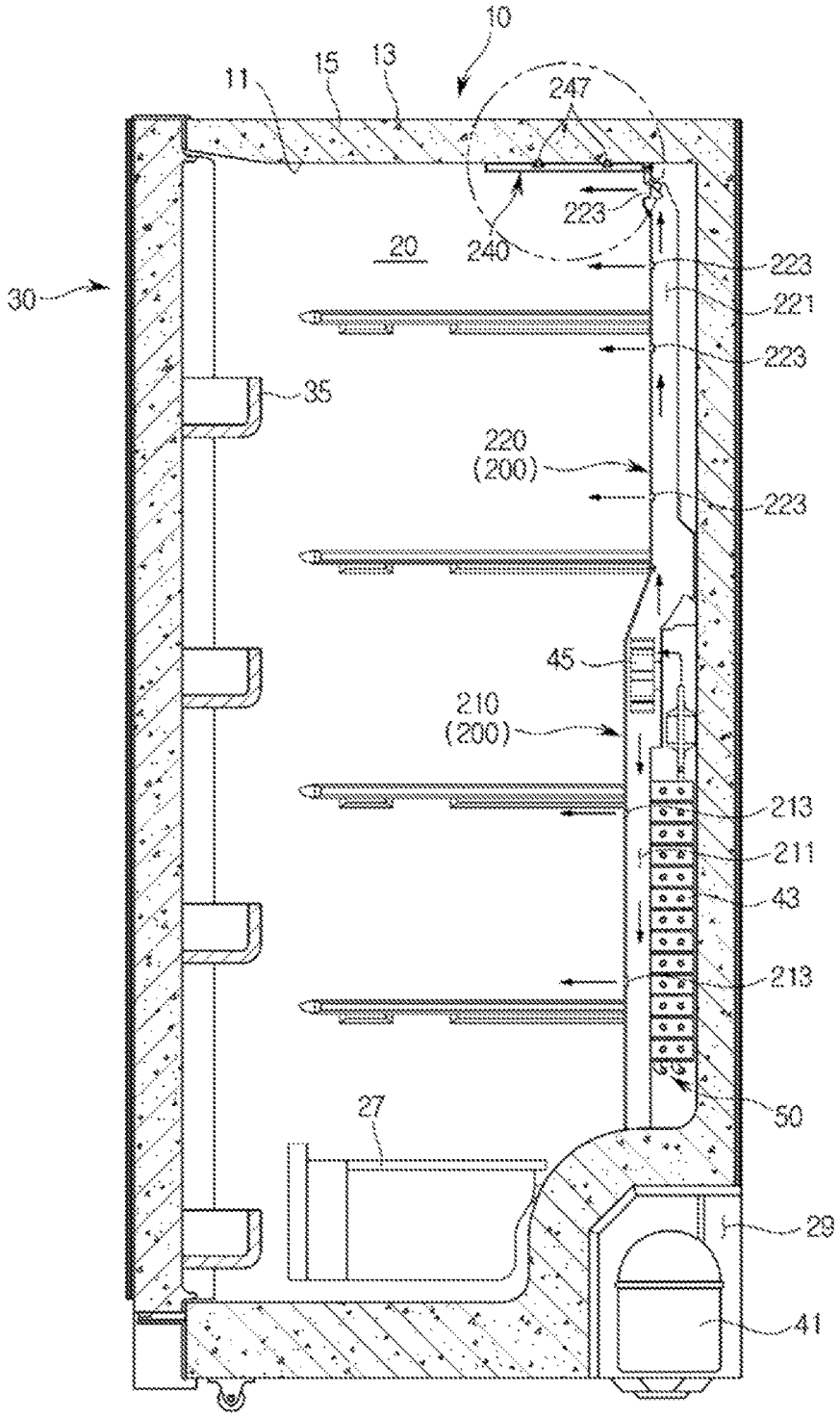
FIG. 20 is a cross-sectional view illustrating a refrigerator in accordance with another embodiment of the present disclosure.
Figure 21:
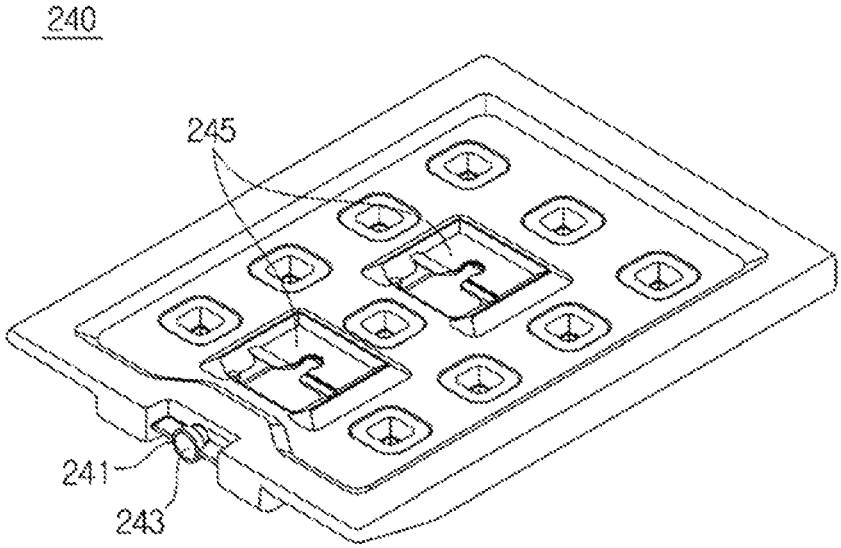
FIG. 21 is a view illustrating a cool pack of FIG. 20.
Figure 22:
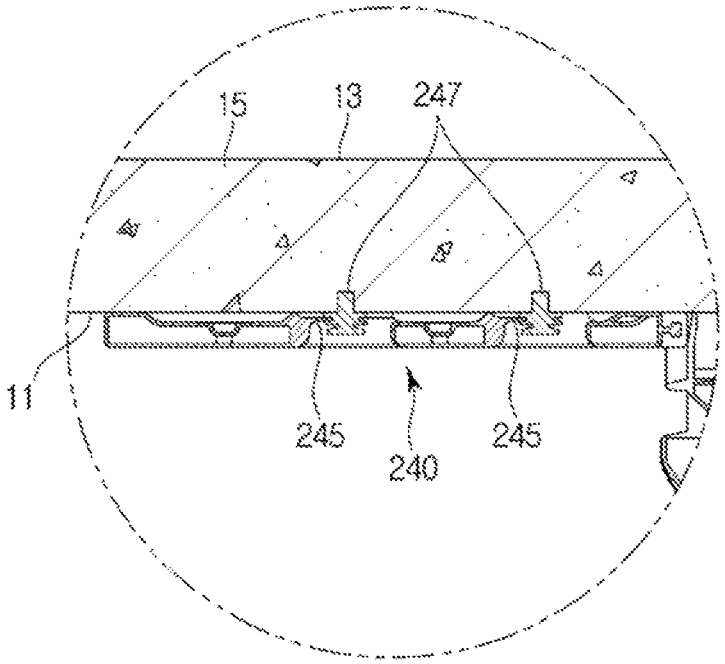
FIG. 22 is a partial enlarged view illustrating that a cool pack of FIG. 20 is mounted to an upper portion of the inside of a storage compartment.

As illustrated in FIGS. 20 to 22, an upper cool pack 240 may be fixed by being coupled to a plurality of fixation protrusions 247 provided in an upper portion of the inside of the storage compartment 20.

The cool pack 240, which is fixed by being coupled to the plurality of fixation protrusions 247 provided in the upper portion of the inside of the storage compartment 20, may include an inlet 241 into which the cold storage material is put, and a plurality of fixation units 245 fixed such that the plurality of the fixation protrusions 247 is inserted thereto.

The inlet 241 may be provided to be opened and closed by a cap 243, and after the inlet 241 is opened by pulling the cap 243 from the inlet 241, the cold storage material may be put into the inside of the cool pack 240 and then the inlet 241 may be closed by the cap 243 when putting the cold storage material is completed.

When the cold storage material is put into the inside of the cool pack 240 and then the inlet 241 is closed by the cap 243, the cool pack 240 may be mounted to an upper portion of the inside of the storage compartment 20 such that the plurality of the fixation units 245 is coupled to the plurality of the fixation protrusions 247 provided on the upper portion of the inside of the storage compartment 20.

Figure 23:
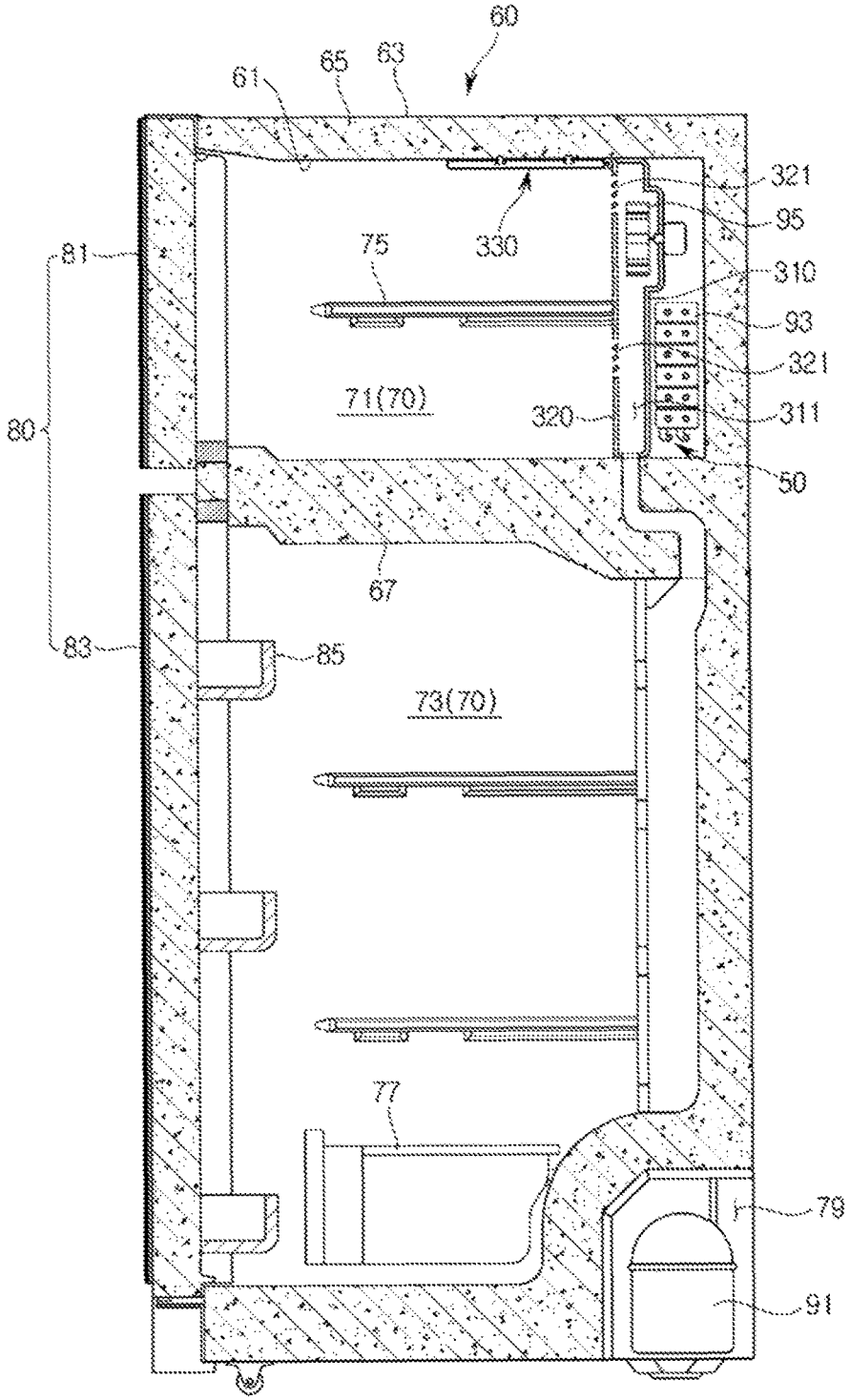
FIG. 23 is a cross-sectional view illustrating a refrigerator in accordance with another embodiment of the present disclosure.

As illustrated in FIG. 23, a refrigerator may include a body 60; a storage compartment 70 provided inside of the body 60 to have an opened front surface thereof; and a door 80 rotatably coupled to the body 60 to open and close the opened front surface of the storage compartment 70.

The body 60 may include an inner case 61 forming the storage compartment 70 and an outer case 63 forming an exterior, and an insulation material 65 may be foamed between the inner case 61 and the outer case 63 to prevent cool air of the storage compartment 70 from being leaked.

The storage compartment 70 may be divided into a freezing compartment 71 that is an upper storage compartment and a refrigerating compartment 73 that is a lower storage compartment, by a partition 67. In the inside of the storage compartment 70, a plurality of shelves 75 configured to store foods thereon may be provided to divide the freezing compartment 71 and the refrigerating compartment 73 into multi-spaces, respectively.

In the inside of the storage compartment 70, a storage container 77 may be provided to store foods.

A machinery room 79 in which a compressor 91 configured to compress refrigerant and a condenser (not shown) configured to condense the compressed refrigerant are installed may be provided in a lower portion of the rear side of the body 60.

The freezing compartment 71 and the refrigerating compartment 73 may be opened or closed by a freezing compartment door 81 and a refrigerating compartment door 83 rotatably coupled to the body 60, respectively, and on the rear surface of the freezing compartment door 81 and the refrigerating compartment door 83, a plurality of door guards 85 may be provided to accommodate foods.

A cool air supplying device (not shown) configured to supply cool air to the inside of the storage compartment 20 may be provided inside of the body 60.

The cool air supplying device may include the compressor 91, the condenser, an expansion valve (not shown), an evaporator 93, a blower fan 95, and a cool air duct 300.

The compressor 91 and the condenser may be provided inside of the machinery room 79, as mentioned above, and the evaporator 93 and the blower fan 95 may be provided in the rear side of the freezing compartment 71.

The evaporator 93 may generate cool air by the heat exchange of the refrigerant, and cool air generated by the evaporator 93 may be guided to the cool air duct 300 by the blower fan 95 provided in an upper side of the evaporator 93 and then the cool air may be supplied to the freezing compartment 71.

Figure 24:
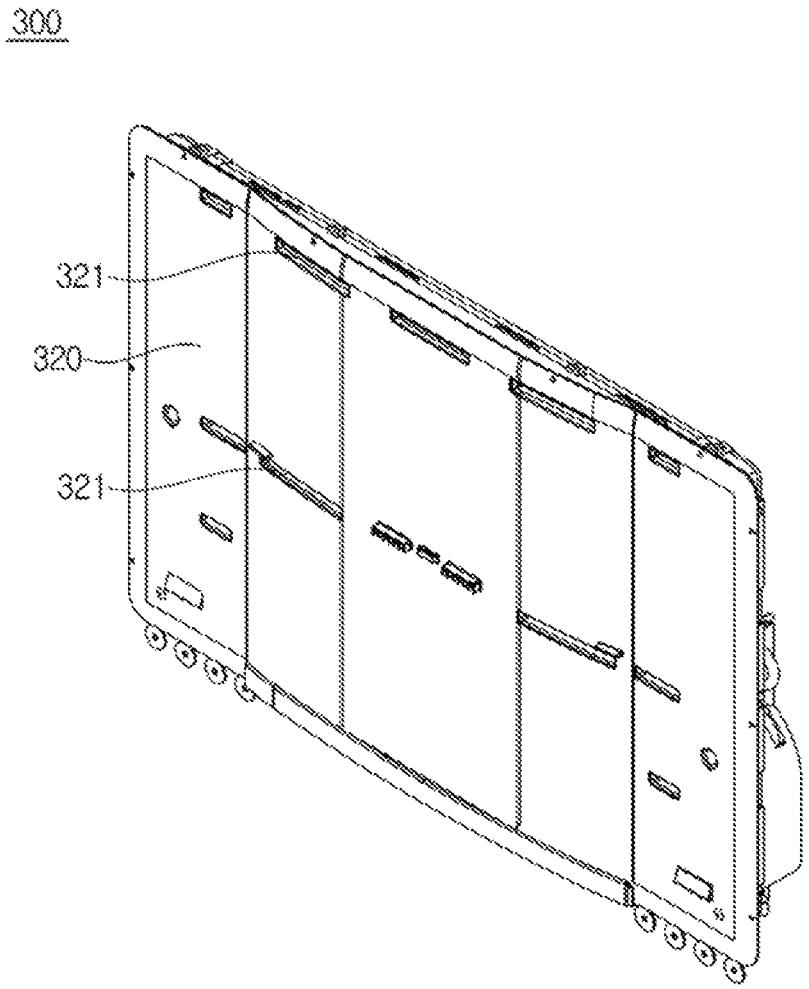
FIG. 24 is a view illustrating a cool air duct in accordance with another embodiment of the present disclosure.
Figure 25:
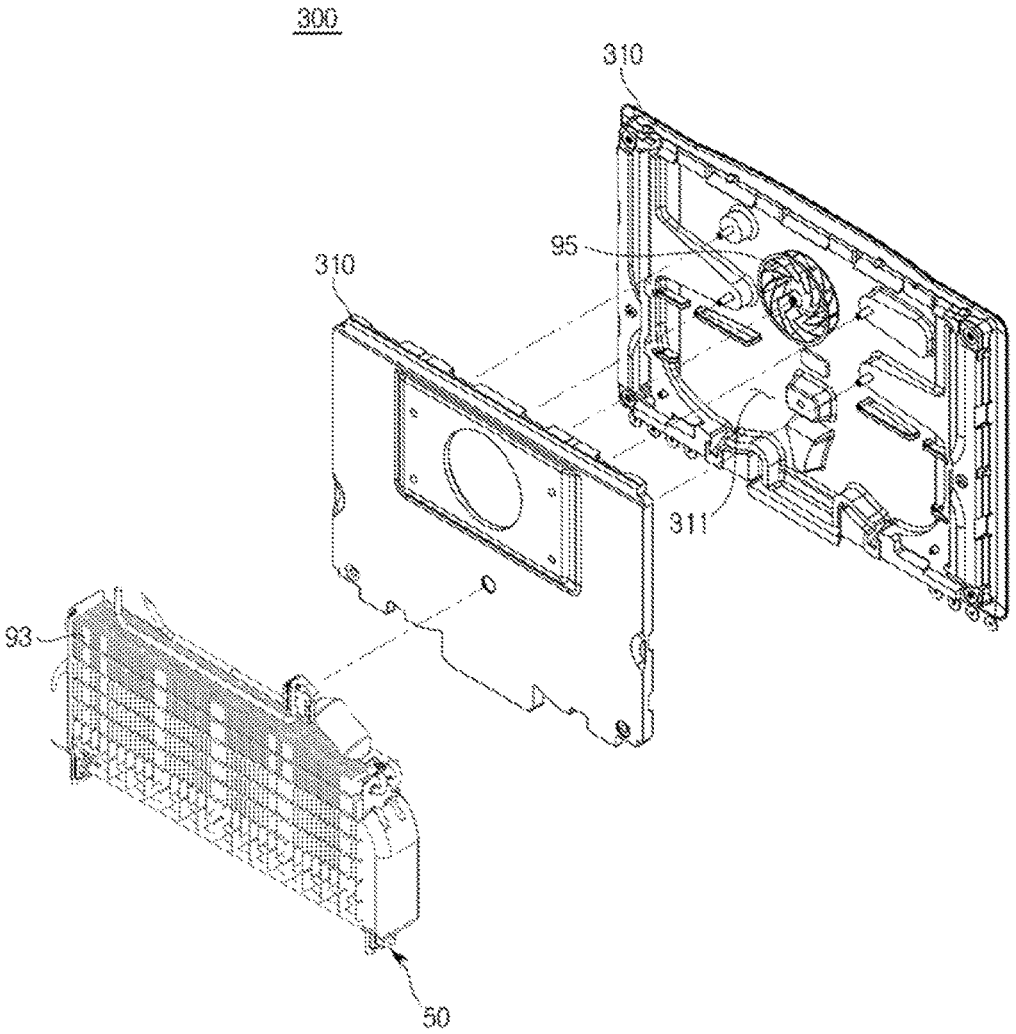
FIG. 25 is a an exploded-perspective view illustrating a cool air duct in accordance with another embodiment of the present disclosure.

As illustrated in FIGS. 23 to 25, the cool air duct 300 may include a flow path unit 310 to which the evaporator 93 and the blower fan 95 are mounted, and in which a flow path 311 is provided; and a front cover 320 provided in a front surface of the flow path unit 310 to form a rear wall of the freezing compartment 71 and in which a plurality of cool air discharging ports 321 configured to discharge cool air, which is delivered to the flow path 311, to the freezing compartment 71 is provided.

Cool air generated by the evaporator 93 may be guided to the flow path 311 by the blower fan 95, a portion of cool air guided to the flow path 311 may be supplied to the freezing compartment 71 via the front cover 320, and the rest of the cool air may be supplied to the refrigerating compartment 73 via a cool air duct provided in the rear side of the refrigerating compartment 73.

A cool pack 330 configured to store the cold storage energy from cool air generated by the evaporator 93 may be provided in an upper portion of the inside of the freezing compartment 71.

Figure 26:
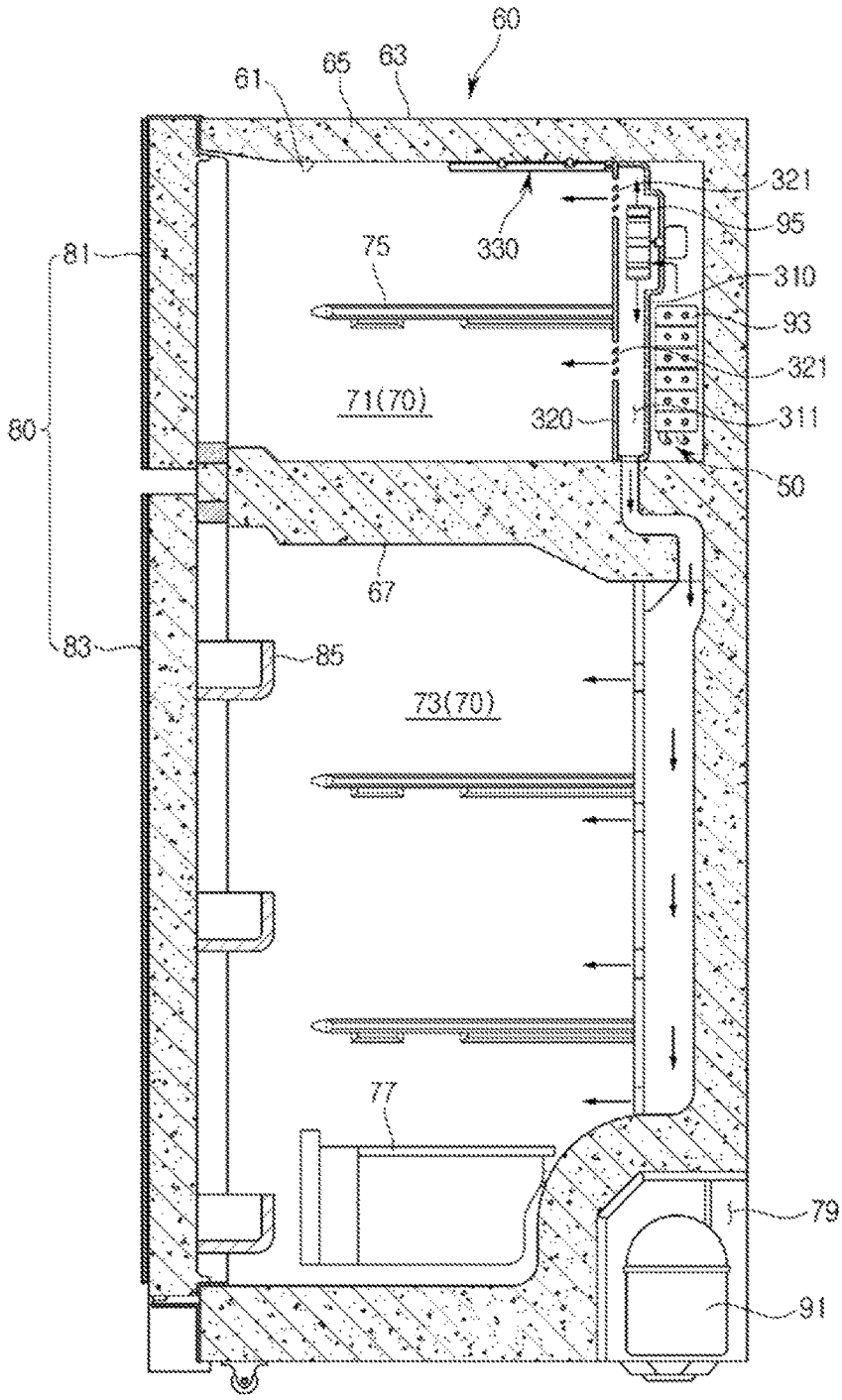
FIG. 26 is a view illustrating that cool air generated by an evaporator of a refrigerator is supplied to a storage compartment in accordance with another embodiment of the present disclosure.

As illustrated in FIG. 26, in a process in which cool air generated by the evaporator 93 is discharged to the freezing compartment 71 via the flow path 311, the cool pack 330 may store the cold storage energy from cool air that is passed through the flow path 311 and discharged via the plurality of the cool air discharging ports 321.

Particularly, the cool pack 330 may store the cold storage energy from cool air that is discharged from the cool air discharging port 321 that is placed in the most upper side among the plurality of the cool air discharging ports 321.

Figure 27:
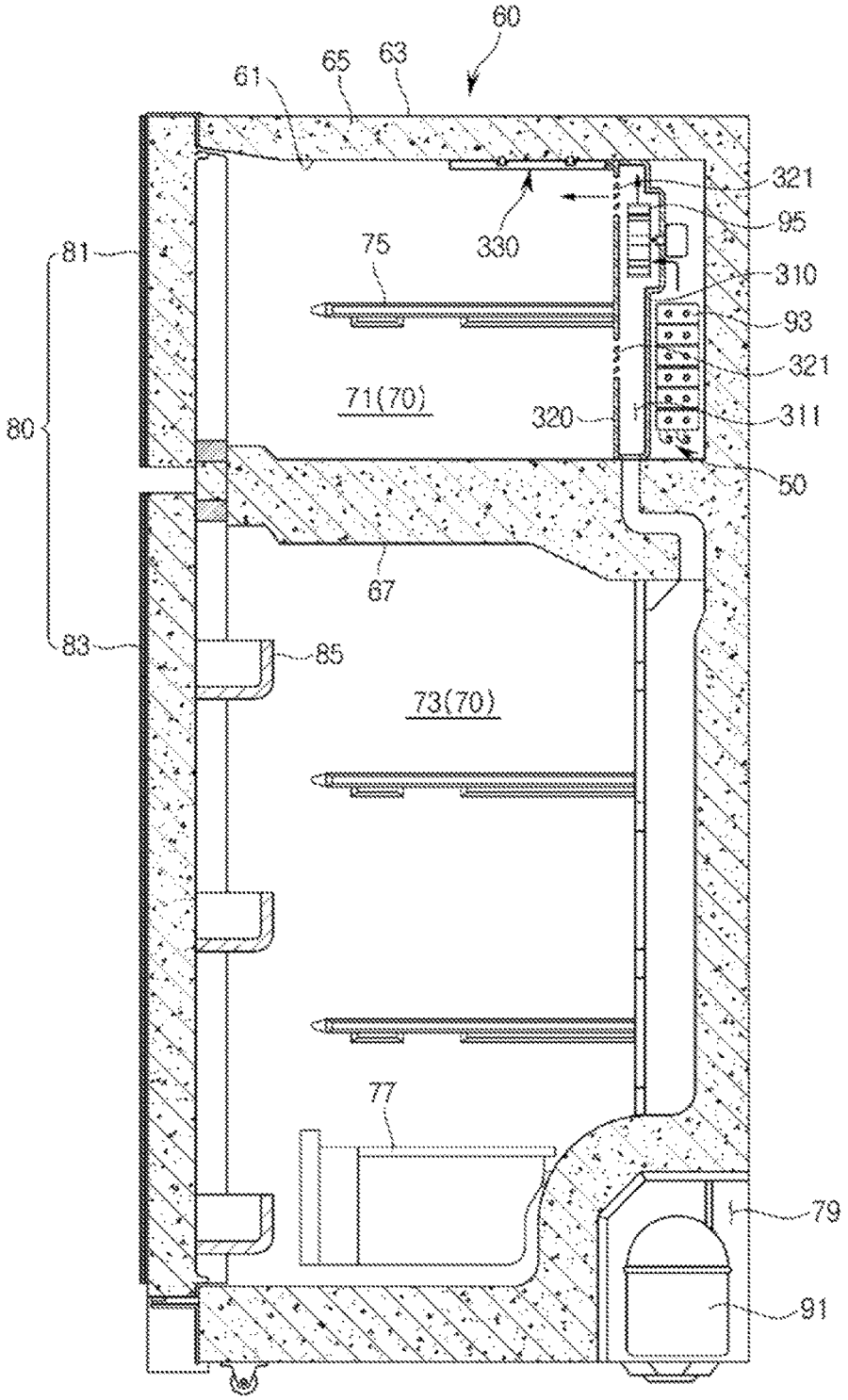
FIG. 27 is a view illustrating that air heated by a defrost heater of a refrigerator is discharged to a storage compartment in accordance with another embodiment of the present disclosure.

As illustrated in FIG. 27, when the defrost heater 50 is operated to remove the ice or frost generated in the cool air discharging port 321, air heated by the defrost heater 50 may be raised due to natural convection and then guided to an upper side of the flow path 311 of the cool air duct 300.

Since air guided to the upper side of the flow path 311 is maintained in a high temperature, an ice or frost generated in the cool air discharging port 321 may be removed by the air having a high temperature so that cool air is smoothly supplied to the freezing compartment 71.

Air heated by the defrost heater 50 may be discharged to the freezing compartment 71 via the cool air discharging port 321 after removing the ice or frost generated in the cool air discharging port 321.

Since air heated by the defrost heater 50 is discharged to the freezing compartment 71 via the cool air discharging port 321 that is placed in the most upper side among the plurality of the cool air discharging ports 321 and the cool pack 330 configured store the cold storage energy is disposed on the upper portion of the inside of the freezing compartment 71, a temperature of air, which is discharged via the cool air discharging port 321 that is placed in the most upper side among the plurality of the cool air discharging ports 321, may be lowered due to the heat exchange with the cool pack 330.

As illustrated in FIGS. 26 to 29, the cool pack 330 may be fixed by being coupled to a plurality of fixation protrusions 337 provided in an upper portion of the inside of the freezing compartment 71.

The cool pack 330, which is fixed by being coupled to the plurality of fixation protrusions 337 provided in the upper portion of the inside of the freezing compartment 71, may include an inlet 331 into which the cold storage material is put, and a plurality of fixation units 335 fixed such that the plurality of the fixation protrusions 337 is inserted thereto.

The inlet 331 may be provided to be opened and closed by a cap 333, and after the inlet 331 is opened by pulling the cap 333 from the inlet 331, the cold storage material may be put into the inside of the cool pack 330 and then the inlet 331 may be closed by the cap 333 when putting the cold storage material is completed.

When the cold storage material is put into the inside of the cool pack 330 and then the inlet 331 is closed by the cap 333, the cool pack 330 may be mounted to an upper portion of the inside of the freezing compartment 71 such that the plurality of the fixation units 335 is coupled to the plurality of the fixation protrusions 337 provided on the upper portion of the inside of the freezing compartment 71.

Although not shown in the drawings, the cool pack 330 may be mounted to an upper surface of the inside of the freezing compartment 71 by a coupling member (B) as the same method as the cool pack 230 as illustrated in FIGS. 16 to 19.

As illustrated in FIGS. 30 to 33, a refrigerator may include a body 400; a storage compartment 410 provided inside of the body 400 to have an opened front surface thereof; and a door 420 rotatably coupled to the body 400 to open and close the opened front surface of the storage compartment 410.

The body 400 may include an inner case 401 forming the storage compartment 410 and an outer case 403 forming an exterior, and an insulation material 405 may be foamed between the inner case 401 and the outer case 403 to prevent a cool air of the storage compartment 410 from being leaked.

The storage compartment 410 may be divided into a plurality of the storage compartments 410 by a partition 407. In the inside of the storage compartment 410, a plurality of shelves 417 and a storage container 418 may be provided to store foods. The opened front surface of the storage compartment 410 may be opened and closed by the door 420.

The storage compartment 410 may be divided into a plurality of storage compartments 411, 414 and 415 by the partition 407, and the partition 407 may include a first partition 408 configured to divide the storage compartment 410 into an upper storage compartment 411 and a lower storage compartment 413 by being horizontally coupled to the inside of the storage compartment 410 and a second partition 409 configured to divide the lower storage compartment 413 into a first storage compartment 414 and a second storage compartment 415 by being vertically coupled to the inside of the lower storage compartment 413.

The partition 407 having a T shape by coupling the first partition 408 to the second partition 409 may divide the storage compartment 410 into three spaces.

The upper storage compartment 411 between the upper storage compartment 411 and the lower storage compartment 413 which are divided by the first partition 408 may be used as a refrigerating compartment and the lower storage compartment 413 may be used as a freezing compartment.

An entire space of the lower storage compartment 413 may be used as a freezing compartment, the first storage compartment 414 may be used as a freezing compartment and the second storage compartment 415 may be used as a refrigerating compartment. Alternatively, the first storage compartment 414 may be used as a freezing compartment and the second storage compartment 415 may be used as both of a freezing compartment and a refrigerating compartment.

The division of the storage compartment 410 is an example, and each of the storage compartments 411, 414 and 415 may be used in a different manner from the above mentioned configuration.

The door 420 may include an upper door 421 configured to open and close the upper storage compartment 411 and a lower door 423 configured to open and close the lower storage compartment 413, and on the rear surface of the door 420, a plurality of door guards 425 may be provided to accommodate foods.

A cool air supplying device (not shown) configured to supply cool air to the inside of the storage compartment 410 may be provided inside of the body 400.

The cool air supplying device may include a compressor 431, a condenser (not shown), an expansion valve (not shown), an evaporator 433 and 435, a blower fan 437 and 439, and a cool air duct 500.

The compressor 431 and the condenser may be provided inside of a machinery room 419 and the evaporator 433 and 435 and the blower fan 437 and 439 may be provided in the rear side of the storage compartment 410.

The evaporator 433 and 435 may generate cool air by the heat exchange of the refrigerant, and cool air generated by the evaporator 433 and 435 may be guided to the cool air duct 500 by the blower fan 437 and 439 provided in an upper side of the evaporator 433 and 435 and then the cool air may be supplied to the storage compartment 410.

The cool air duct 500 may include a first cool air duct 510 provided in a rear side of the lower storage compartment 413 and a second cool air duct 520 provided in a rear side of the upper storage compartment 411.

A second evaporator 435 and a second blower fan 439 may be mounted to the second cool air duct 520, and the second cool air duct 520 may include a second flow path 521 configured to guide cool air generated by the second evaporator 435 to be supplied to the upper storage compartment 411; and a second cool air discharging port 523 configured to discharge the cool air to the inside of the upper storage compartment 411.

A first evaporator 433 and a first blow fan 437 may be mounted to the first cool air duct 510, and the first cool air duct 510 may include a first flow path 511 configured to guide cool air generated by the first evaporator 433 to be supplied to the lower storage compartment 413 and a first cool air discharging port 521 configured to discharge the cool air to the inside of the lower storage compartment 413.

A defrost heater 440 may be provided in a lower side of the first evaporator 433. When an ice or frost is generated in the first cool air discharging port 513 provided in the first cool air duct 510 and thus cool air generated in the first evaporator 433 is prevented from being discharged to the lower storage compartment 413, the defrost heater 440 may be operated to allow cool air to be smoothly discharged to the lower storage compartment 413 by removing the ice and frost generated in the first cool air discharging port 513.

The first cool air duct 510 provided in the rear side of the lower storage compartment 413 may be provided in the rear side of the first storage compartment 414 and the second storage compartment 415, respectively.

Figure 33:
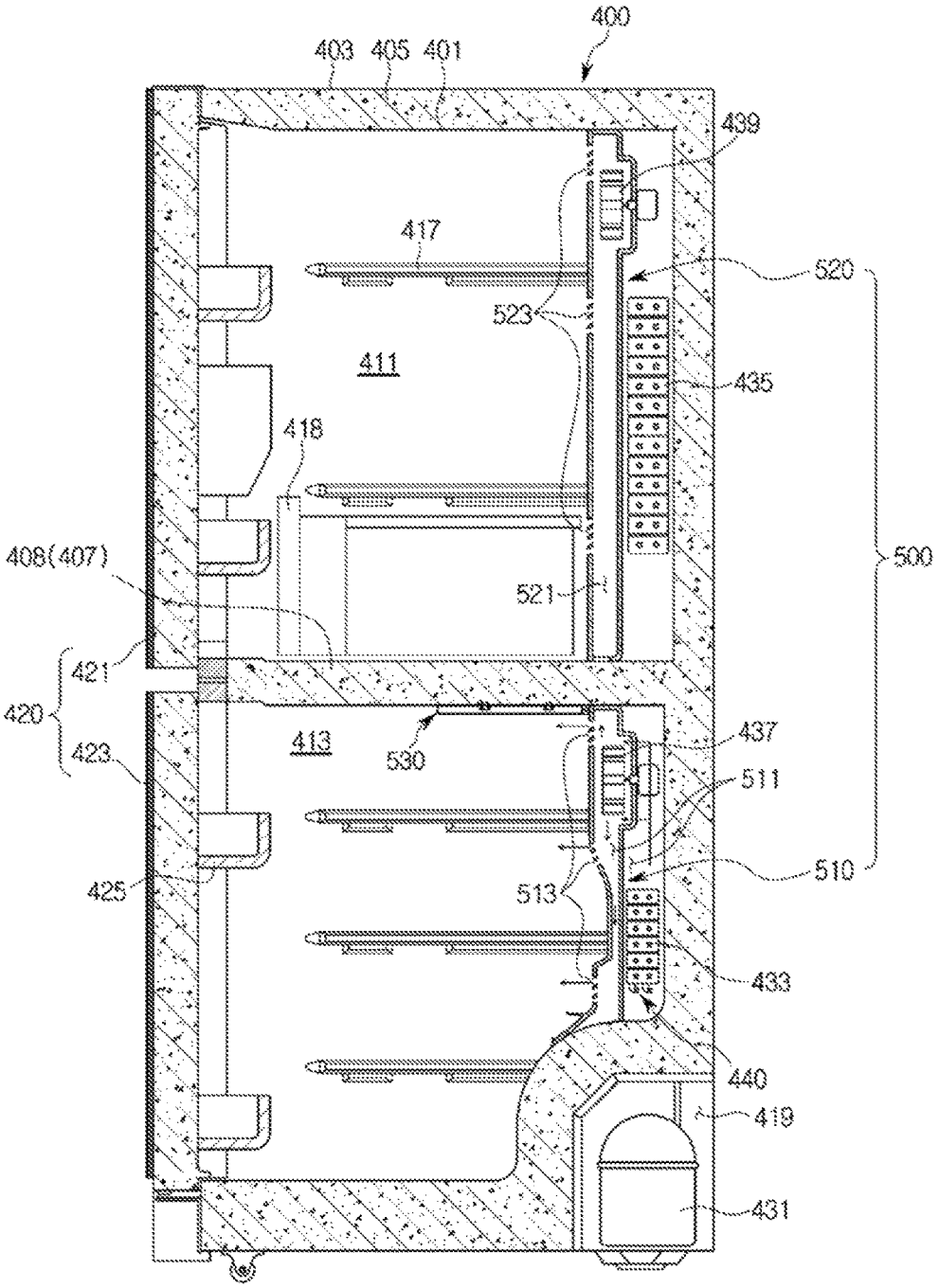
FIG. 33 is a view illustrating that cool air generated by a first evaporator of a refrigerator, in which a cool pack is mounted to an upper surface of the inside of a lower storage compartment, is supplied to the lower storage compartment in accordance with another embodiment of the present disclosure.

A cool pack 530 in which cold storage material is filled may be provided on an upper surface of the inside of the lower storage compartment 413, and as illustrated in FIG. 33, in a process in which cool air generated by the first evaporator 433 is discharged to the lower storage compartment 413 via the first flow path 511, the cool pack 530 may store the cold storage energy from the cool air that is passed through the first flow path 511 and discharged via the plurality of the first cool air discharging ports 513.

Particularly, the cool pack 530 may store the cold storage energy from cool air that is discharged from the first cool air discharging port 513 that is placed in the most upper side among the plurality of the first cool air discharging ports 513.

Figure 34:
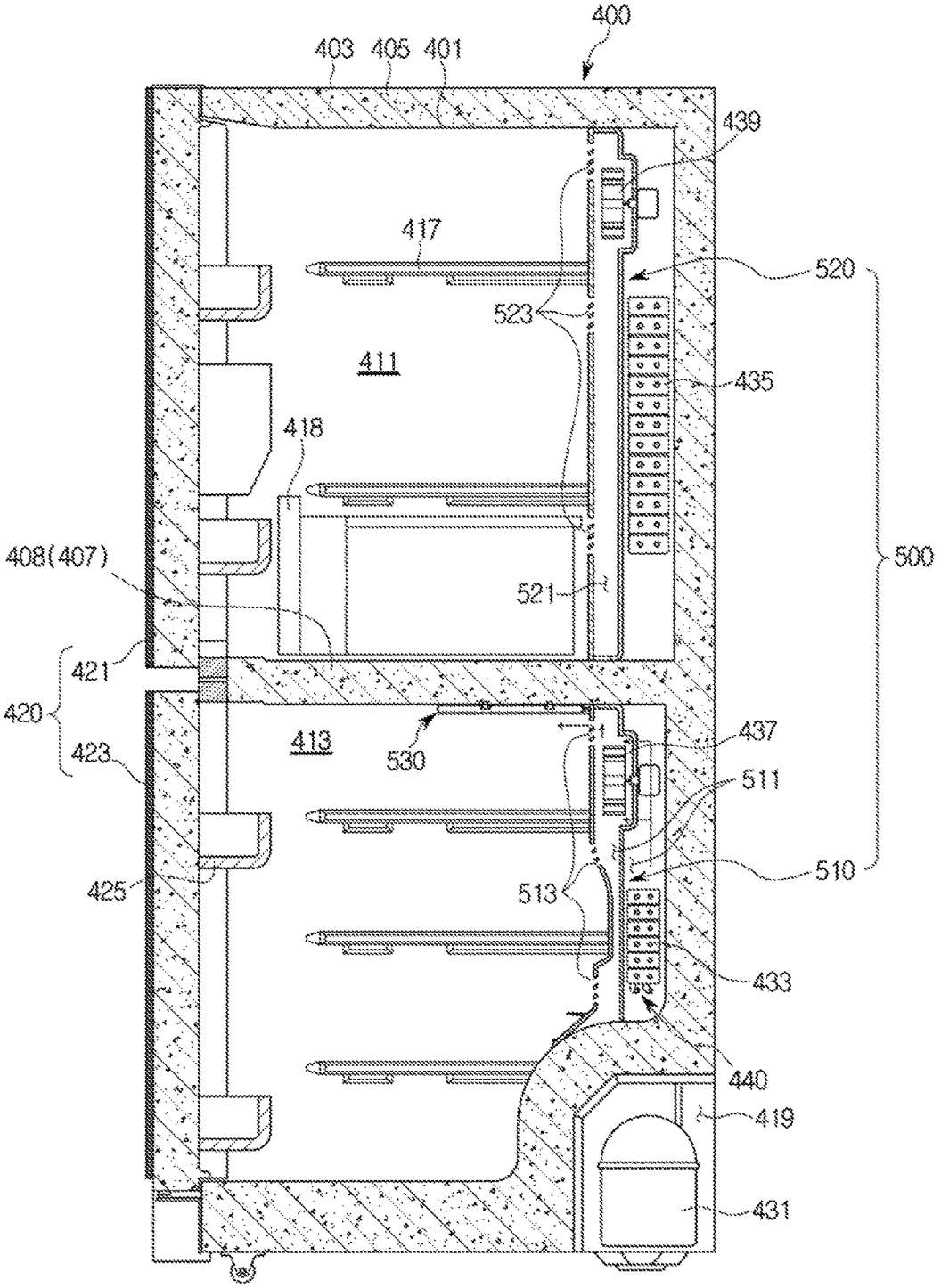
FIG. 34 is a view illustrating that air heated by a defrost heater of a refrigerator, in which a cool pack is mounted to an upper surface of the inside of a lower storage compartment, is discharged to the lower storage compartment in accordance with another embodiment of the present disclosure.

As illustrated in FIG. 34, when the defrost heater 440 is operated to remove the ice or frost generated in the first cool aft discharging port 513, air heated by the defrost heater 440 may be raised due to natural convection and then guided to an upper side of the first flow path 511 of the first cool air duct 510.

Since air guided to the upper side of the first flow path 511 is maintained in a high temperature, an ice or frost generated in the first cool air discharging port 513 may be removed by the air having a high temperature so that cool air is smoothly supplied to the lower storage compartment 413.

Air heated by the defrost heater 440 may be discharged to the lower storage compartment 413 via the first cool air discharging port 513 after removing the ice or frost generated in the first cool air discharging port 513.

Since air heated by the defrost heater 440 is discharged to the lower storage compartment 413 via the first cool air discharging port 513 that is placed in the most upper side among the plurality of the first cool air discharging ports 513 and the cool pack 530 configured store the cold storage energy is disposed on the upper surface of the inside of the lower storage compartment 413, a temperature of air, which is discharged via the first cool air discharging port 513 that is placed in the most upper side among the plurality of the first cool air discharging ports 513, may be lowered due to the heat exchange with the cool pack 530.

A temperature of air, which is discharged from the first cool air discharging port 513 that is placed in the most upper side, may be lowered and thus the increase of an internal temperature of the lower storage compartment 413 may be delayed.

Figure 35:
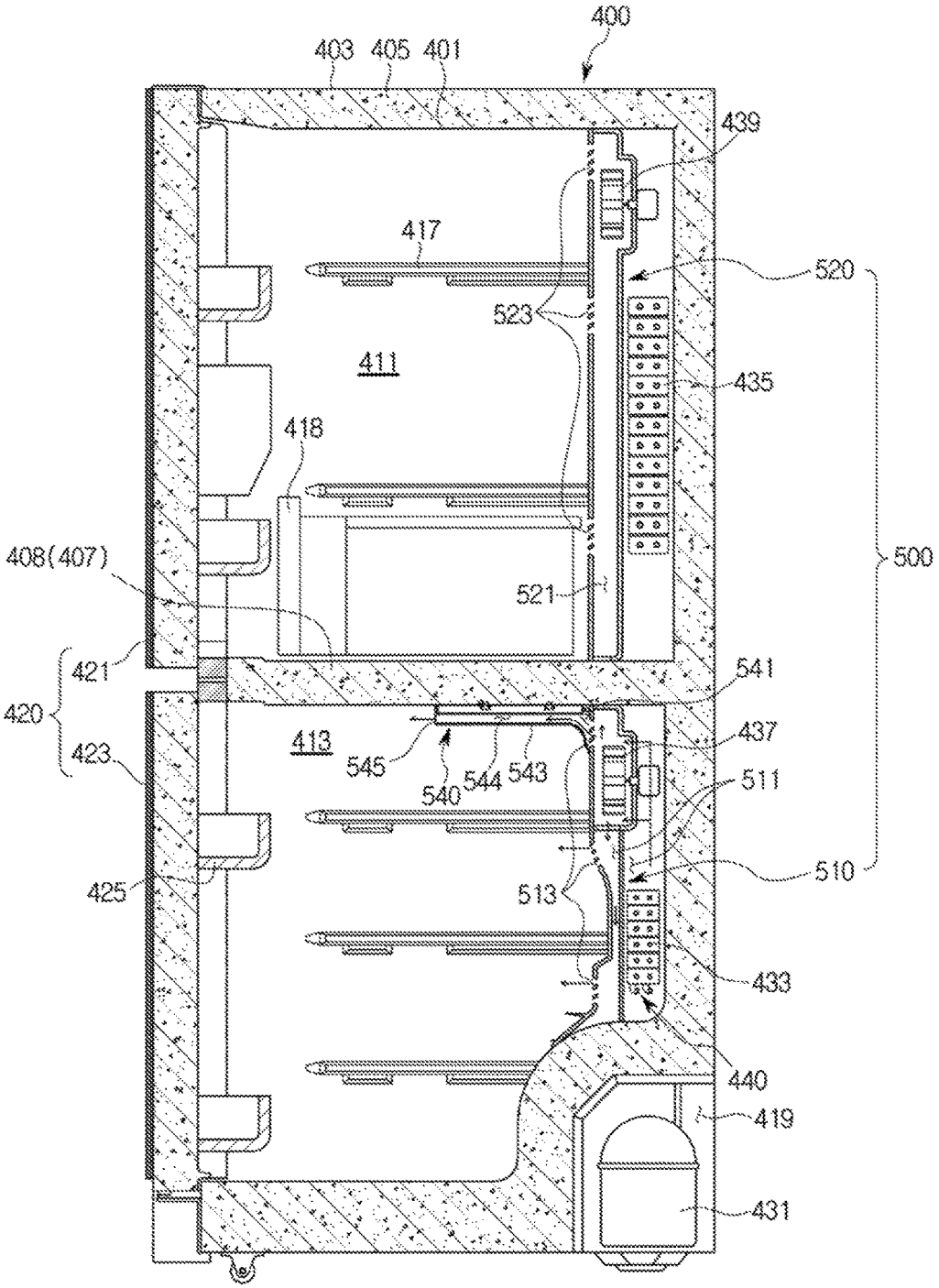
FIG. 35 is a view illustrating that cool air generated by a first evaporator of a refrigerator, in which a cool pack and an auxiliary flow path are provided, is supplied to a lower storage compartment in accordance with another embodiment of the present disclosure.
Figure 36:
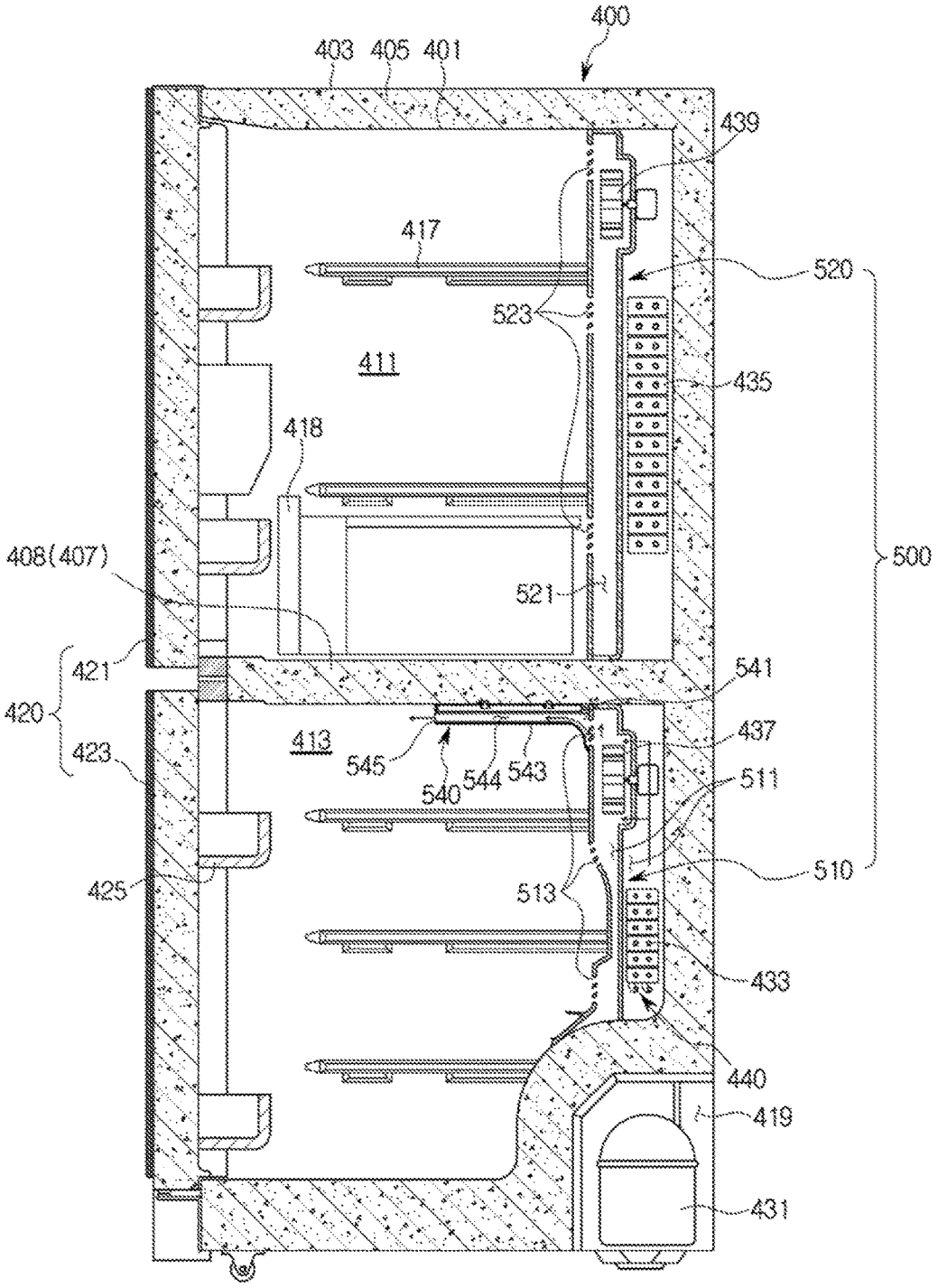
FIG. 36 is a view illustrating that air heated by a defrost heater of a refrigerator, in which a cool pack and an auxiliary flow path are provided, is discharged to a lower storage compartment in accordance with another embodiment of the present disclosure.

As illustrated in FIGS. 35 and 36, an auxiliary flow path unit 540, which is communicated with the first cool air discharging port 513 that is placed in the most upper side among the plurality of the first cool air discharging ports 513, may be provided in a lower side of the cool pack 530.

The auxiliary flow path unit 540 may be provided to be communicated with the first cool air discharging port 513 that is placed in the most upper side among the plurality of the first cool air discharging ports 513 to be adjacent to the cool pack 530, and the auxiliary flow path unit 540 may include a communicating port 541 communicated with the first cool air discharging port 513; a flow path cover 543 extended toward the front side from the communicating port 541 to form an auxiliary flow path 544 through which cool air is passed; and a discharging port 545 provided on a front surface of the flow path cover 543 to allow cool air to be discharged.

As illustrated in FIG, 35, in a process in which cool air generated by the first evaporator 433 is discharged to the first cool air discharging port 513 via the first flow path 511, and cool air generated by the first evaporator 433 is discharged to the discharging port 545 via the communicating port 541 and the auxiliary flow path 544, the cool pack 530 may store the cold storage energy by directly making contact with cool air that is passed through the auxiliary flow path 544.

Since cool air discharged from the first cool air discharging port 513 directly makes contact with the cool pack 530, the cool pack 530 may more efficiently store the cold storage energy.

As illustrated in FIG, 36, air heated by the defrost heater 440 may be discharged to the lower storage compartment 413 via the first cool air discharging port 13 after removing the ice or frost generated in the first cool air discharging port 513.

In a state in which air heated by the defrost heater 440 is discharged to the lower storage compartment 413 via the first cool air discharging port 513 that is placed in the most upper side among the plurality of the first cool air discharging ports 513, since the first cool air discharging port 513 that is placed in the most upper side is communicated with the auxiliary flow path unit 540, air heated by the defrost heater 440 may directly make contact with the cool pack 530 in a process of being discharged to the discharging port 545 via the first cool air discharging port 513, the communicating port 541 and the auxiliary flow path 544.

Since heated air directly makes contact with the cool pack 530, the heat exchange may be effectively performed and thus a temperature of the heated air may be lower than a temperature of a heated air that is not passed through the auxiliary flow path unit 540. Accordingly, the increase of a temperature of the inside of the lower storage compartment 413 may be effectively delayed.

Figure 28:
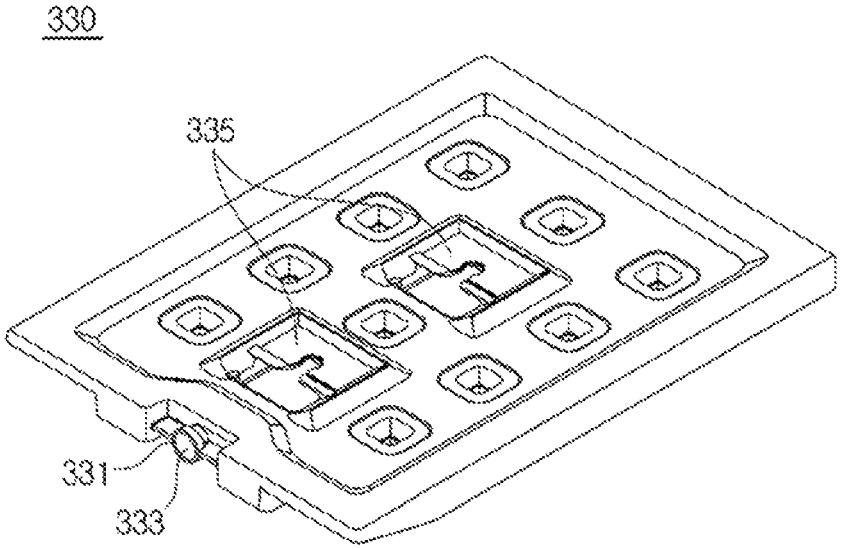
FIG. 28 is a view illustrating a cool pack of FIG. 26.
Figure 29:
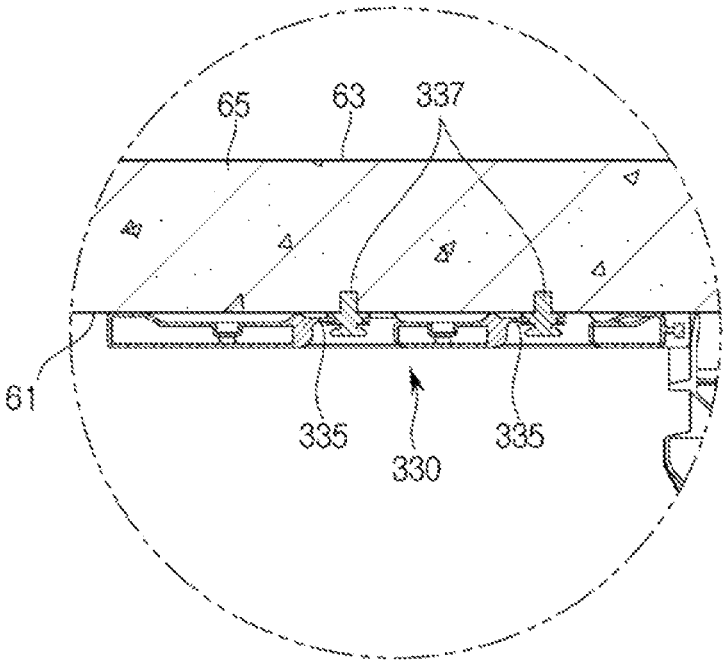
FIG. 29 is a partial enlarged view illustrating that a cool pack of FIG. 26 is mounted to an upper portion of the inside of a freezing compartment.
Figure 30:
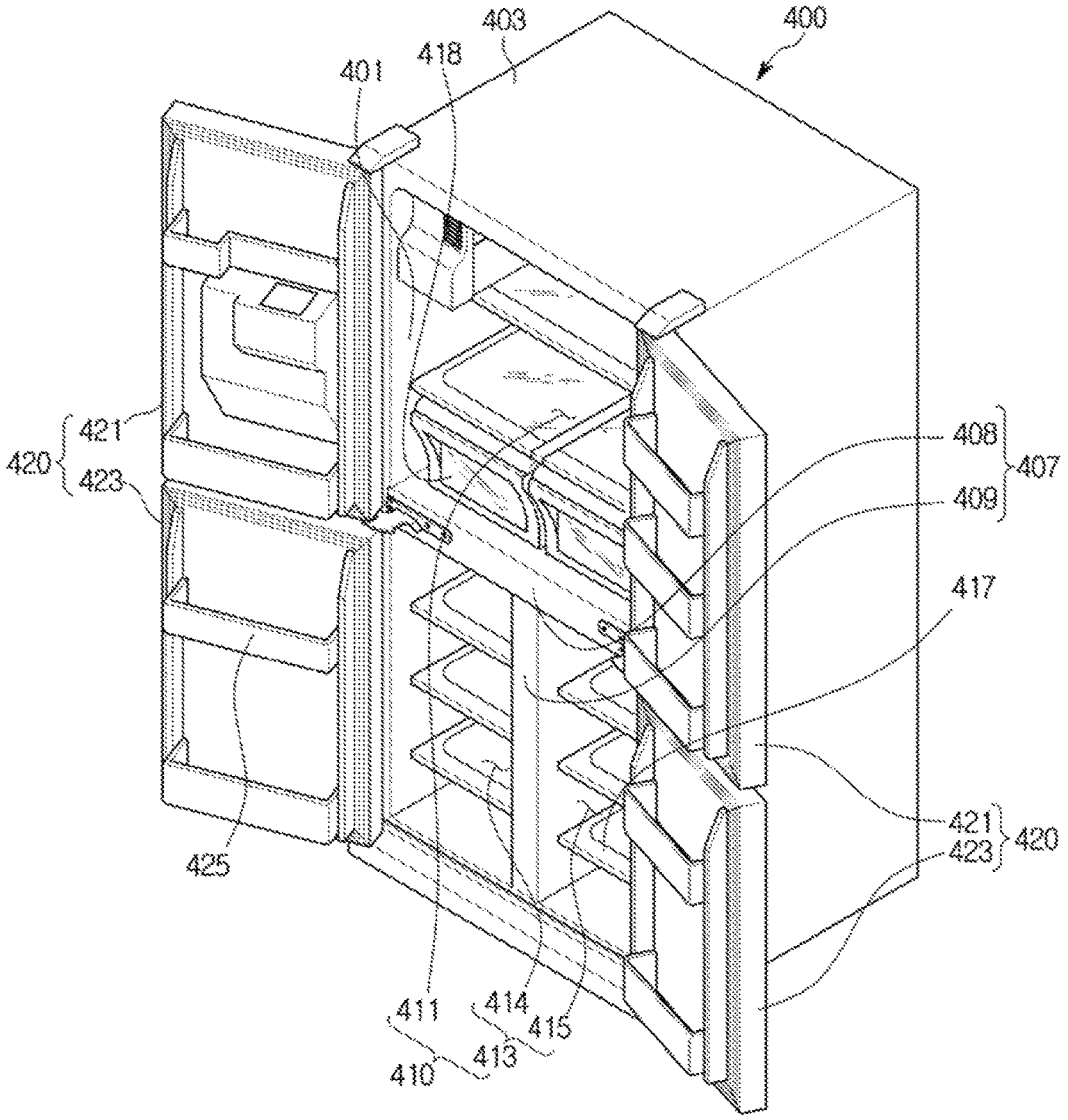
FIG. 30 is a perspective view illustrating a refrigerator in accordance with another embodiment of the present disclosure.
Figure 31:
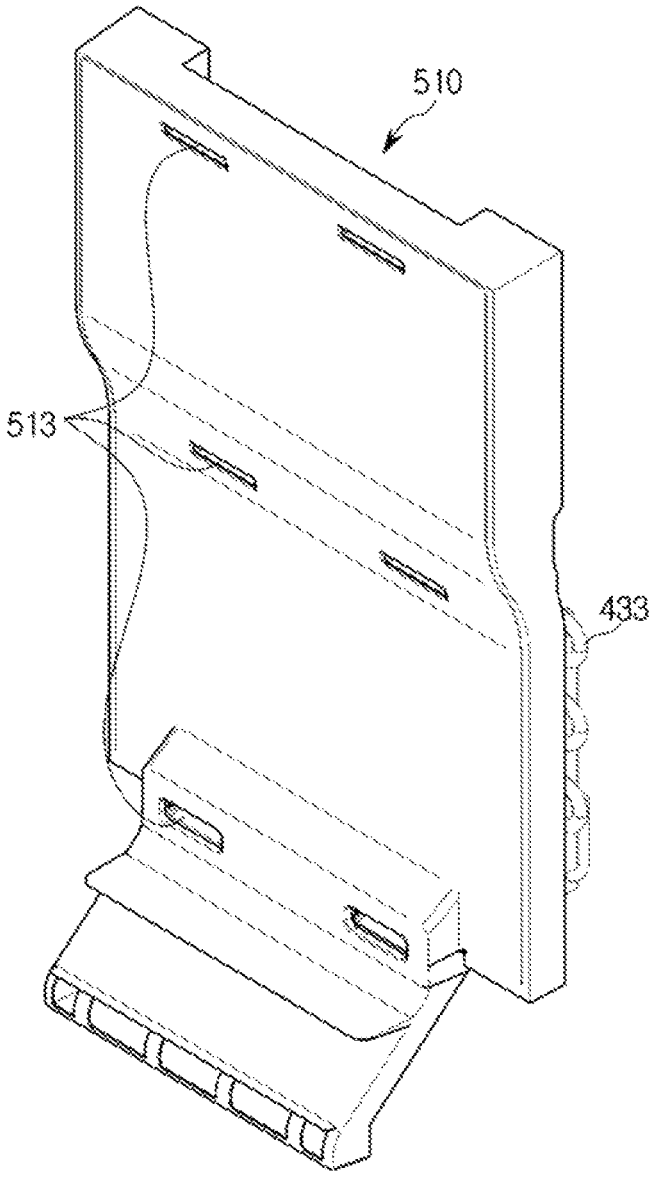
FIG. 31 is a perspective view illustrating a cool air duct in accordance with another embodiment of the present disclosure.
Figure 32:
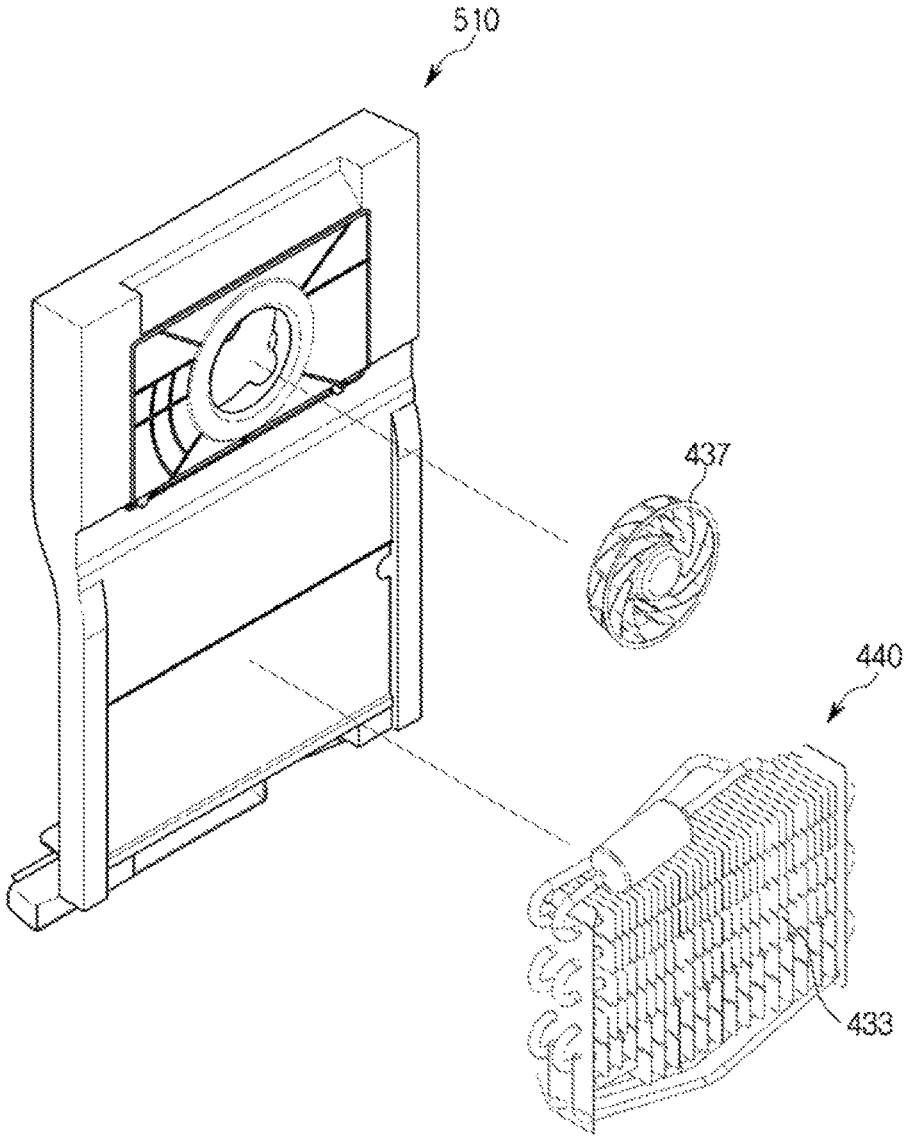
FIG. 32 is an exploded-perspective view illustrating a cool air duct in accordance with another embodiment of the present disclosure.

A configuration of the cool pack 530 and a structure in which the cool pack 530 is mounted to an upper surface of the inside of the lower storage compartment 413 may be the same as the cool pack 330 illustrated in FIGS. 28 and 29, and thus a description thereof will be omitted.

Figure 37:
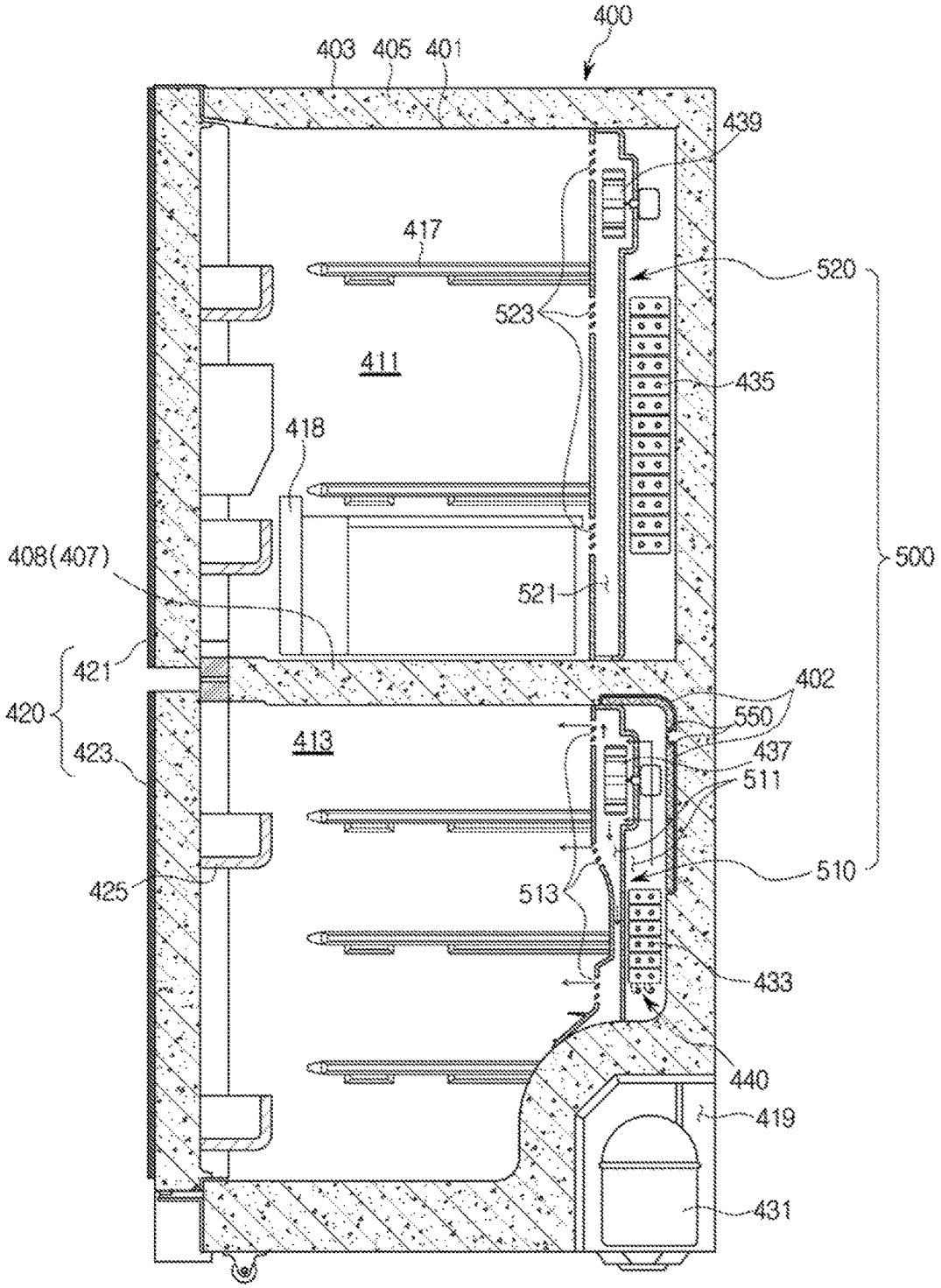
FIG. 37 is a view illustrating that cool air generated by a first evaporator of a refrigerator, to which an inner case cool pack is mounted, is supplied to a lower storage compartment in accordance with another embodiment of the present disclosure.
Figure 38:
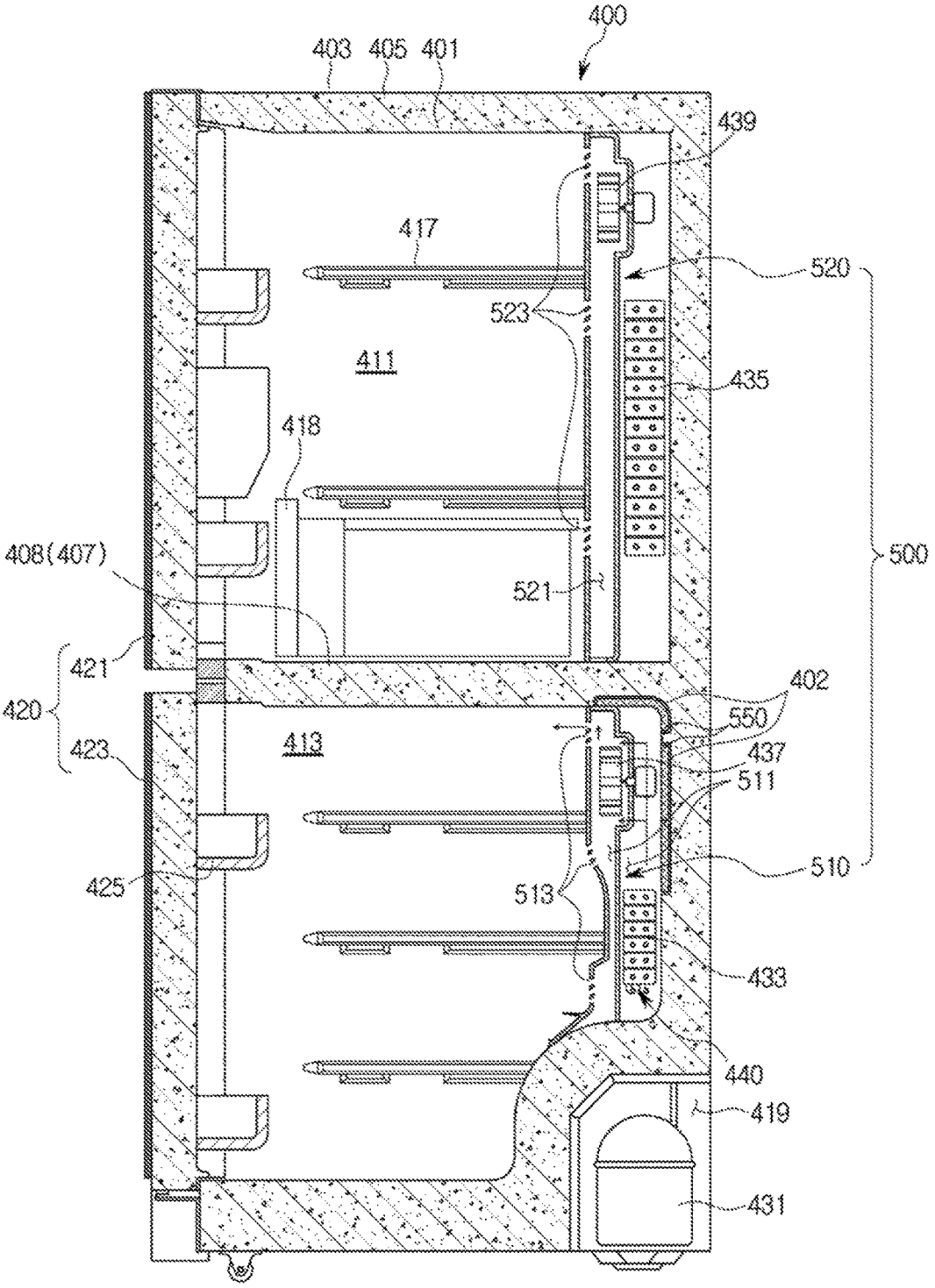
FIG. 38 is a view illustrating that air heated by a defrost heater of a refrigerator, to which an inner case cool pack is mounted, is discharged to a lower storage compartment in accordance with another embodiment of the present disclosure.

As illustrated in FIGS. 37 and 38, an inner case cool pack 550 in which cold storage material is filled may be mounted adjacent to a first flow path 511 of a first cool air duct 510.

The inner case cool pack 550 may be provided in plural, and the inner case cool pack 550 may be mounted to an internal surface of an inner case 401.

A cool pack mounting unit 402 recessed toward the outside may be provided on the internal surface of the inner case 401 to allow the inner case cool pack 550 to be mounted thereto.

As illustrated in FIG. 37, in a process in which cool air generated by the first evaporator 433 is passed through the first flow path 511, the inner case cool pack 550 may store the cold storage energy from the cool air.

As illustrated in FIG. 38, in a process in which air heated by the defrost heater 440 is passed through the first flow path 511, a temperature of the heated air may be lowered due to the heat exchange with the inner case cool pack 550. The heated air in a lowered temperature may be discharged to the inside of the lower storage compartment 413 and thus the increase of an internal temperature of the lower storage compartment 413 may be effectively delayed.

Although the drawings illustrates that the inner case cool pack 550 is mounted to the internal surface of the inner case 401, the inner case cool pack 550 may be mounted to an external surface of the inner case 401 so as to be disposed between the inner case 401 and the outer case 403.

Figure 39:
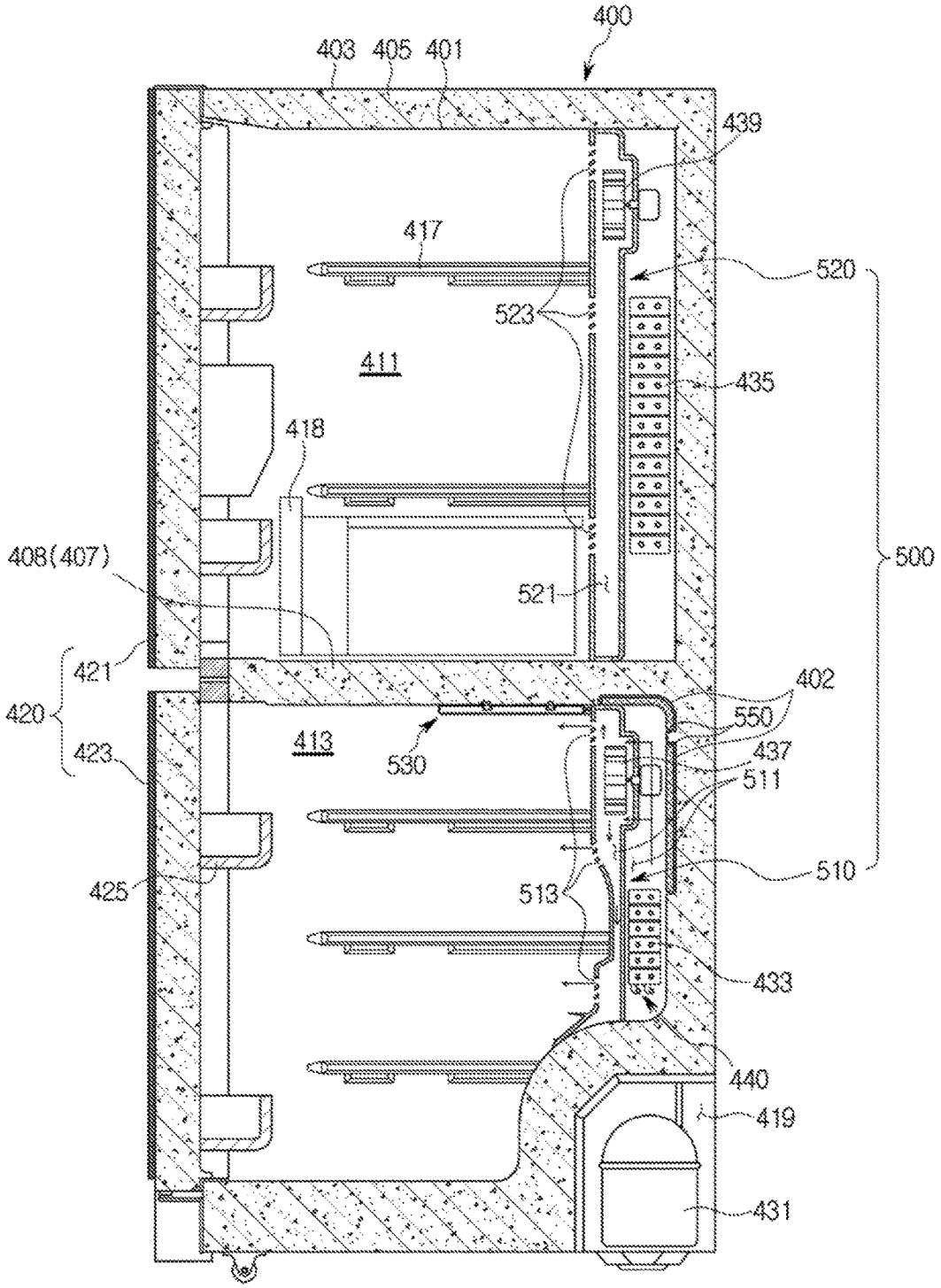
FIG. 39 is a view illustrating that cool air generated by a first evaporator of a refrigerator, in which a cool pack and an inner case cool pack are provided, is supplied to a lower storage compartment in accordance with another embodiment of the present disclosure.
Figure 40:
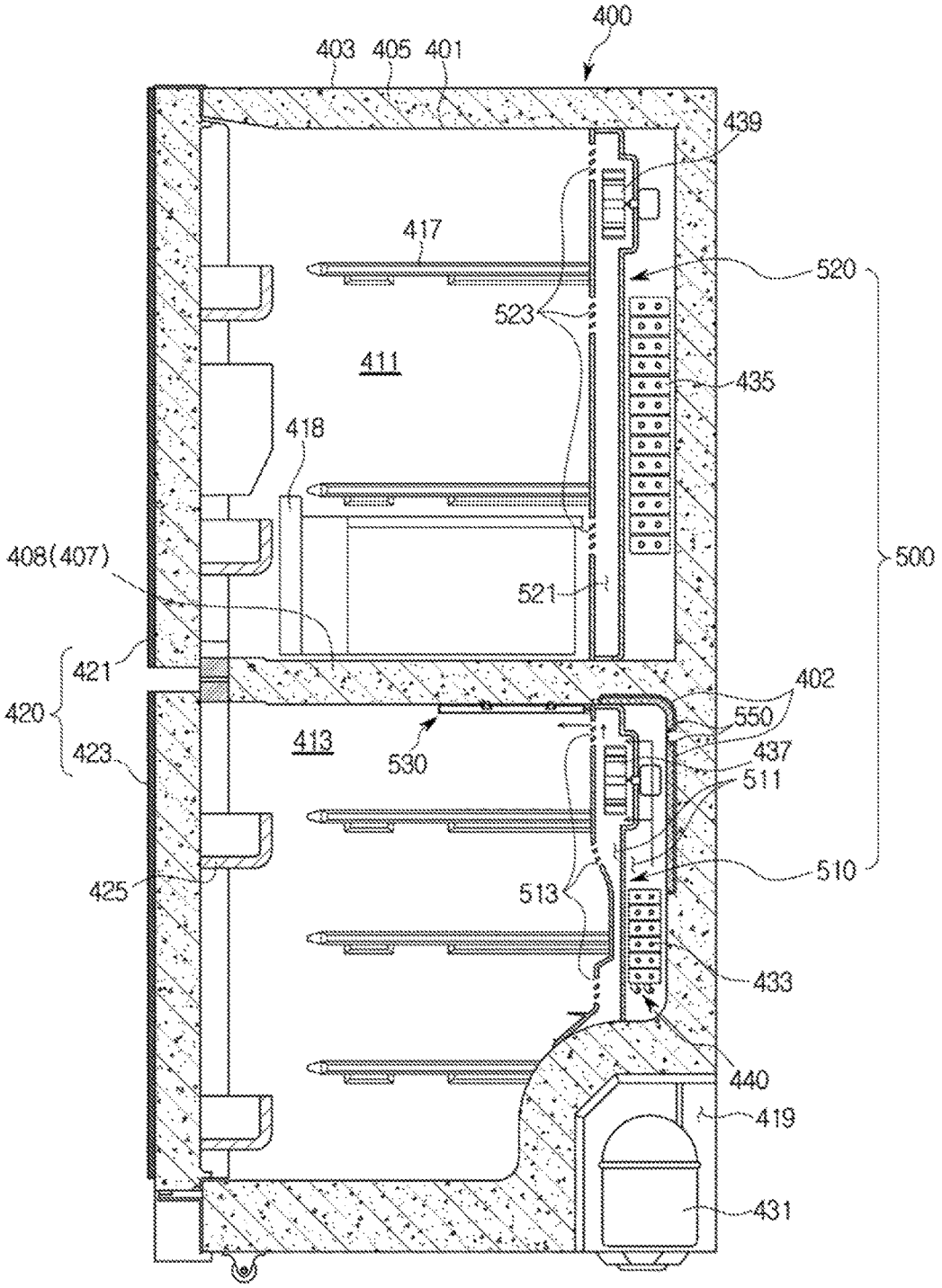
FIG. 40 is a view illustrating that air heated by a defrost heater of a refrigerator, in which a cool pack and an inner case cool pack are provided, is discharged to a lower storage compartment in accordance with another embodiment of the present disclosure.

As illustrated in FIGS. 39 and 40, together with the inner case cool pack 550 mounted to the inner case 401, a cool pack 530 may be mounted to an upper surface of the inside of the lower storage compartment 413.

As illustrated in FIG. 39, in a process in which cool air generated by the first evaporator 433 is passed through the first flow path 511, the inner case cool pack 550 may store the cold storage energy from the cool air, and the cool pack 530 may store the cold storage energy from cool air discharged via the first cool air discharging port 513.

As illustrated in FIG. 40, in a process in which air heated by the defrost heater 440 is passed through the first flow path 511, a temperature of the heated air may be lowered due to the heat exchange with the inner case cool pack 550. The heated air in a lowered temperature, which is discharged via the first cool air discharging port 513, may perform the heat exchange with the cool pack 530 again and thus the temperature of the heated air may be more lowered. Accordingly, the increase of the internal temperature of the lower storage compartment 413 may be more effectively delayed.

As is apparent from the above description, according to the proposed refrigerator, it may be possible to delay the increase of the internal temperature of the storage compartment as much as possible, when defrosting is performed, Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a body;

a storage compartment provided inside of the body to have an opening;

an evaporator provided in a rear side of the storage compartment to generate cool air;

a defrost heater provided in a lower side of the evaporator;

a lower cool air duct provided with the evaporator mounted thereto, the lower cool air duct configured to guide cool air to a lower portion of the storage compartment;

an upper cool air duct disposed above the lower cool air duct, the upper cool air duct configured to guide cool air to an upper portion of the storage compartment;

a fan disposed between the lower cool air duct and the upper cool air duct to guide cool air to the lower cool air duct and the upper cool air duct; and a cool pack disposed in the upper cool air duct, the cool pack configured to store cold energy from cool air passing through the upper air duct, wherein the cool pack is configured to perform heat exchange with air heated by the defrost heater while the defrost heater is being operated.

2. The refrigerator of claim 1, wherein the lower cool air duct comprises:

a flow path unit to which the evaporator and the fan are mounted, and a first front cover provided to a front surface of the flow path unit to form a part of a rear wall of the storage compartment, and the first front cover having a plurality of first cool air discharging ports configured to discharge cool air that is delivered to the storage compartment.

3. The refrigerator of claim 2 wherein the upper cool air duct comprises:

a second front cover provided to a front surface of the cool pack to form another part of the rear wall of the storage compartment, and the second front cover having a plurality of second cool air discharging ports configured to discharge cool air that is delivered to the storage compartment.

4. The refrigerator of claim 3, wherein a rear cover configured to cover a rear side of the cool pack is provided to the rear side of the cool pack.

5. The refrigerator of claim 4, wherein the cool pack comprises:

an inlet configured to allow storage material to be filled, and a third cool air discharging ports provided at a position corresponding to the plurality of second cool air discharging ports to discharge the cool air that is delivered to the storage compartment.

6. The refrigerator of claim 5, comprising:

a plurality of protrusions protruded toward the rear side of the storage compartment, the plurality of protrusions being provided on a rear surface of the cool pack.

7. The refrigerator of claim 6, wherein an upper cool pack in which cold storage material is filled is mounted to the upper portion of the storage compartment inside the storage compartment, wherein the upper cool pack stores cold storage energy from cool air discharged via the plurality of second cool air discharging ports.

8. The refrigerator of claim 7, wherein the upper cool pack comprises:

a coupling hole configured to allow the upper cool pack to be coupled to the upper portion of the storage compartment inside the storage compartment by a coupling member.

9. The refrigerator of claim 7, comprising:

a plurality of fixation protrusions provided to the upper portion of the storage compartment inside the storage compartment, and a plurality of fixation units provided to the upper cool pack to be fixed by being coupled to the plurality of fixation protrusions.

10. The refrigerator of claim 1, wherein the upper cool air duct and the lower cool air duct include corresponding discharging ports configured to discharge cool air generated by the evaporator to the storage compartment, and the defrost heater is controlled to be operated while cool air generated by the evaporator for discharge via the corresponding discharging ports is prevented from being discharged to the storage compartment.

* * * * *